US011024938B2

(12) United States Patent
Moon et al.

(10) Patent No.: US 11,024,938 B2
(45) Date of Patent: Jun. 1, 2021

(54) ANTENNA MODULE AND ELECTRONIC DEVICE COMPRISING SAME

(71) Applicant: Samsung Electronics Co., Ltd., Suwon-si (KR)

(72) Inventors: Heecheul Moon, Suwon-si (KR); Sangyoup Seok, Suwon-si (KR); Kwonho Son, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/884,406

(22) Filed: May 27, 2020

(65) Prior Publication Data

US 2020/0287268 A1 Sep. 10, 2020

Related U.S. Application Data

(63) Continuation of application No. PCT/KR2019/010468, filed on Aug. 19, 2019.

(30) Foreign Application Priority Data

Aug. 22, 2018 (KR) ..... 10-2018-0097964

(51) Int. Cl.
*H01Q 1/24* (2006.01)
*H01Q 1/22* (2006.01)
(Continued)

(52) U.S. Cl.
CPC ..... *H01Q 1/02* (2013.01); *H01Q 1/2208* (2013.01); *H01Q 1/243* (2013.01); *H01Q 1/42* (2013.01)

(58) Field of Classification Search
CPC ..... H01Q 1/241; H01Q 1/242; H01Q 1/243; H01Q 1/2208; H01Q 1/42; H01Q 1/24
See application file for complete search history.

(56) References Cited

U.S. PATENT DOCUMENTS 8,933,845 B2 * 1/2015 Kim ..... H01Q 1/243 343/702
2004/0155821 A1 * 8/2004 Ohara ..... H01Q 19/106 343/700 MS
(Continued)

FOREIGN PATENT DOCUMENTS

CN 107394350 A 11/2017
CN 206878159 U 1/2018
(Continued)

OTHER PUBLICATIONS

Korean Office Action dated Oct. 5, 2020, issued in Korean Application No. 10-2018-0097964.
(Continued)

*Primary Examiner* — Hoang V Nguyen
(74) *Attorney, Agent, or Firm* — Jefferson IP Law, LLP

(57) ABSTRACT

An electronic device is provided. The electronic device including a housing comprising a front plate which faces a first direction, a back plate which faces a second direction opposite from the first direction, and a lateral member which surrounds a space between the front plate and the back plate and has at least one part formed from a metal material, a display seen through a first part of the front plate, an antenna module positioned inside the space, and a wireless communication circuit. The antenna module includes a first surface facing a third direction forming an acute angle with the second direction, a second surface facing a fourth direction opposite from the third direction, at least one first conductive element disposed on the first surface or inside the antenna module so as to face the third direction, and at least one second conductive element which is adjacent to the lateral member between the first surface and the second surface and extends in a fifth direction different from the third direction
(Continued)

and the fourth direction and facing between the lateral surface and the first part of the front plate.

28 Claims, 21 Drawing Sheets

(51) Int. Cl.
*H01Q 1/02* (2006.01)
*H01Q 1/42* (2006.01)

(56) References Cited

U.S. PATENT DOCUMENTS

| | | | |
|---|---|---|---|
| 2010/0302109 | A1 | 12/2010 | Takahashi |
| 2012/0064843 | A1 | 3/2012 | Kim et al. |
| 2012/0262348 | A1 | 10/2012 | Kubo et al. |
| 2016/0276734 | A1 | 9/2016 | Jin et al. |
| 2017/0062899 | A1 | 3/2017 | Takahashi et al. |
| 2017/0201014 | A1 | 7/2017 | Lee et al. |
| 2017/0207516 | A1 | 7/2017 | Koo et al. |
| 2017/0250460 | A1* | 8/2017 | Shin ..... H01Q 1/243 |
| 2018/0026341 | A1 | 1/2018 | Mow et al. |
| 2018/0301799 | A1 | 10/2018 | Imai et al. |
| 2019/0103653 | A1 | 4/2019 | Jeong et al. |
| 2019/0257933 | A1 | 8/2019 | Nath et al. |
| 2019/0312334 | A1 | 10/2019 | Shin et al. |
| 2020/0227821 | A1 | 7/2020 | Wu et al. |

FOREIGN PATENT DOCUMENTS

| | | | |
|---|---|---|---|
| CN | 108352605 | A | 7/2018 |
| CN | 108432041 | A | 8/2018 |
| JP | 2012-130056 | A | 7/2012 |
| KR | 10-2015-0008998 | A | 1/2015 |
| KR | 10-2017-0082799 | A | 7/2017 |
| KR | 10-2017-0087334 | A | 7/2017 |
| WO | 2017/098719 | A1 | 6/2017 |

OTHER PUBLICATIONS

Chinese Office Action dated Nov. 12, 2020, issued in Chinese Application No. 201980006101.0.

Extended European Search Report dated Mar. 1, 2021, issued in European Application No. 19851152.9.

* cited by examiner

ANTENNA MODULE AND ELECTRONIC DEVICE COMPRISING SAME

CROSS-REFERENCE TO RELATED APPLICATION(S)

This application is a continuation application, claiming priority under § 365(c), of an International application No. PCT/KR2019/010468, filed on Aug. 19, 2019, which was based on and claimed the benefit of a Korean patent application number 10-2018-0097964, filed on Aug. 22, 2018, in the Korean Intellectual Property Office, the disclosure of which is incorporated by reference herein in its entirety.

BACKGROUND

1. Field

Various embodiments relate to an antenna module and an electronic device including the antenna module.

2. Description of Related Art

Electronic devices may output information stored therein as sound or an image. As the degree of integration of electronic devices has increased and super-high-speed and large-capacity RF communication has become popular, various functions have recently been provided in a single electronic device, such as a mobile communication terminal. For example, various functions, such as an entertainment function (e.g., a game function), a multimedia function (e.g., a music/video reproduction function), a communication and security function for mobile banking or the like, a schedule management function, and an e-wallet function, are integrated in a single electronic device, in addition to a communication function.

In communication devices mounted in electronic devices, efforts are underway to develop a next-generation communication system such as a next-generation (e.g., $5^{th}$-generation) communication system or a pre-next-generation communication system in order to meet the growing demand for wireless data traffic, which has been an increasing trend since the commercialization of a 4G ($4^{th}$-generation) communication system.

In order to achieve a high data transmission rate, the next-generation communication system is being implemented in an ultra-high-frequency band (e.g., a band of 6 GHz or higher and 300 GHz or lower) such as a millimeter (mm) wave band. In order to mitigate a path loss of radio waves and to increase a transmission distance of radio waves in the ultra-high-frequency band, beamforming technology, massive multi-input multi-output (massive MIMO) technology, full-dimensional MIMO (FD-MIMO) technology, antenna array technology, analog beamforming technology, and large-scale antenna technology are being developed for implementation in next-generation communication systems.

SUMMARY

Transmission and/or reception by an antenna may be implemented by an outer housing of an electronic device, a metal radiator inside the electronic device, or a metal trace on a printed circuit board.

The above-described antenna structure may be appropriate when using a low frequency band (e.g., 6 GHz or lower), but when using a high frequency band (e.g., 6 GHz or higher) having a strong rectilinear advancing property, the antenna structure is not capable of implementing efficient transmission and reception. For example, the antenna structure for using a frequency band equal to or higher than a predetermined frequency (e.g., 6 GHz or higher) should be implemented with an antenna module including multiple dipole antennas, patch antennas, or transceiver circuits, and for efficient transmission and reception, the antenna structure may be disposed in the state of being spaced apart from elements that prevent transmission and reception inside the electronic device (e.g., a component including a metal material or a display).

According to various embodiments, it is possible to implement an antenna module disposed in an electronic device so as to be spaced apart from an outer metal housing for efficient transmission and reception and an antenna housing structure equipped with the antenna module.

An electronic device according to various embodiments may include a case forming at least part of an external appearance of the electronic device; a printed circuit board disposed in an inner space of the case; an antenna module positioned in the inner space, and including at least one first conductive element arranged to form a predetermined slope with respect to one face of the printed circuit board; an RF communication module electrically connected with the antenna module and configured to transmit and/or receive a signal having a frequency of 6 GHz to 300 GHz; and a heat dissipation member disposed adjacent to the antenna module and configured to dissipate heat generated from the antenna module.

An electronic device according to various embodiments may include a front cover forming at least part of a front face of the electronic device; a rear cover forming at least part of a rear face of the electronic device; a display disposed adjacent to the front cover to be seen through a first portion of the front cover; a printed circuit board disposed between the display and the rear cover; an antenna housing located between the display and the rear cover and including an inclined face forming a predetermined slope with respect to the printed circuit board; and an antenna module disposed on the inclined face of the antenna housing. The antenna module may include a board, a first conductive element including an array of multiple conductive plates disposed on or inside the board, and an RF communication circuit electrically connected to the first conductive element and configured to transmit and/or receive a signal having a frequency of 6 GHz to 300 GHz.

A portable communication device according to various embodiments may include a display including a flat face; a housing including a first wall that accommodates therein the display and is substantially parallel to the flat face of the display and a second wall that is substantially perpendicular to the first wall, wherein the second wall includes a conductive portion and a non-conductive portion located between the first wall and the conductive portion; an antenna support member that is spaced apart from the second wall of the housing and includes a face inclined with respect to the first wall of the housing; and an antenna structure disposed on the inclined face of the antenna support member. The antenna structure may include a printed circuit board disposed to be inclined with respect to the first wall of the housing; and an antenna array disposed on the printed circuit board to be inclined with respect to the first wall of the housing, and a first separation distance between an edge of the antenna array farthest from the first wall of the housing and the first wall of the housing may be smaller than a second separation distance between the conductive portion of the second wall of the housing and the first wall of the housing.

An electronic device according to various embodiments may include a housing including a first plate exposed in a first direction, a second plate exposed in a second direction, which is opposite the first direction, and a side member formed at an edge of a space between the first plate and the second plate so as to connect the first plate and the second plate to each other; and an antenna module disposed within the space so as to be adjacent to the side member, and including a first face oriented in a third direction forming an acute angle with the second direction, wherein the antenna module may include a plurality of conductive plates disposed on the first face in order to transmit an electromagnetic signal in the third direction.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
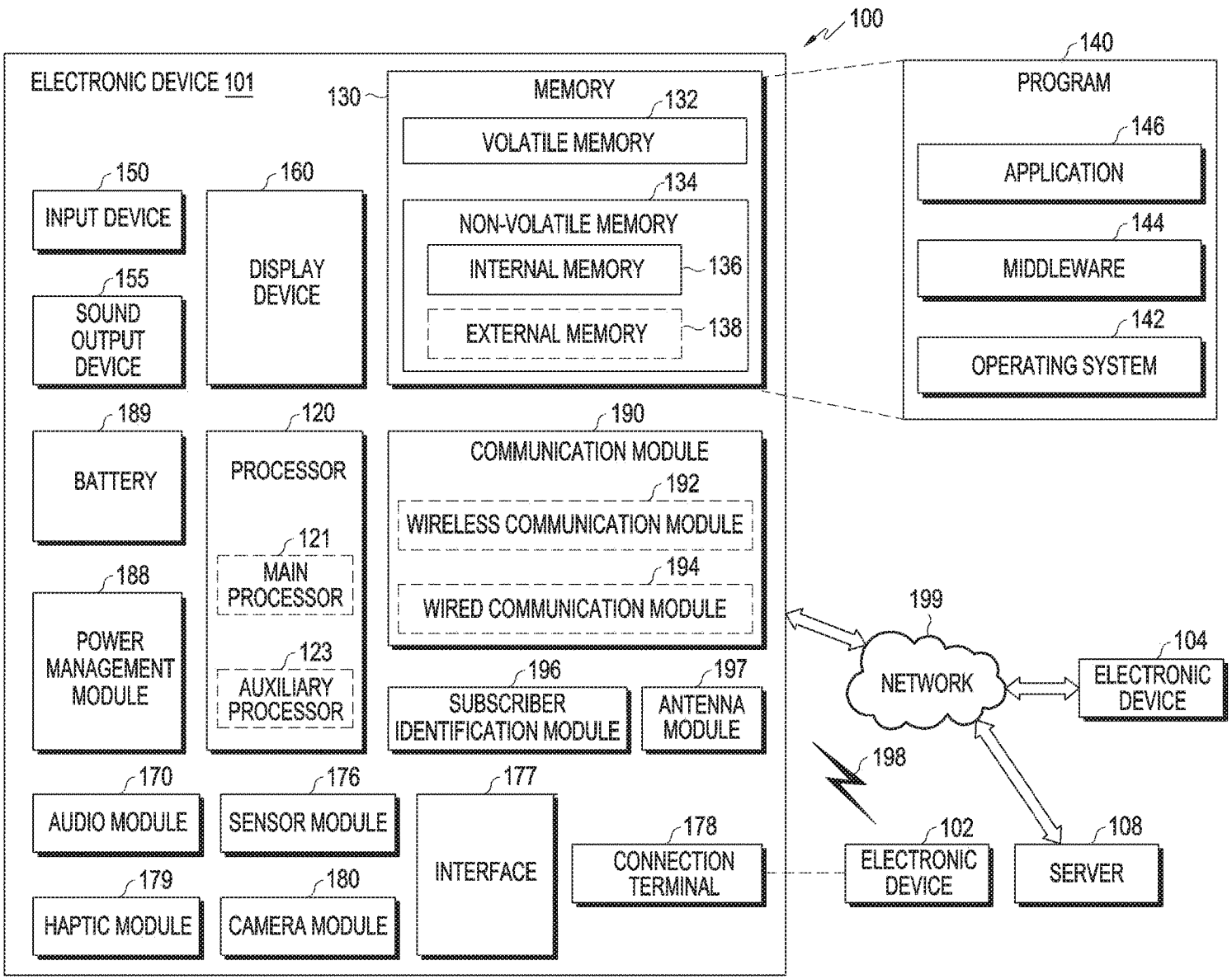
FIG. 1 is a block diagram of an electronic device according to various embodiments in a network environment.

FIG. 1 is a block diagram illustrating an electronic device 101 in a network environment 100 according to various embodiments.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199

(e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
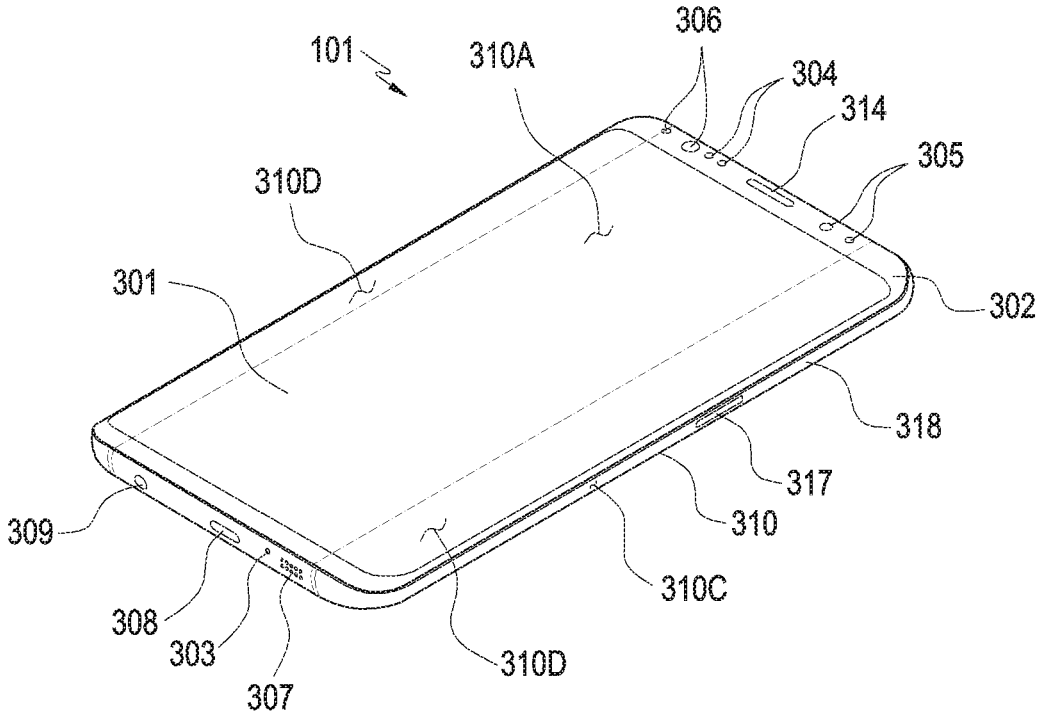
FIG. 2 is a front side perspective view illustrating an electronic device according to various embodiments.
Figure 3:
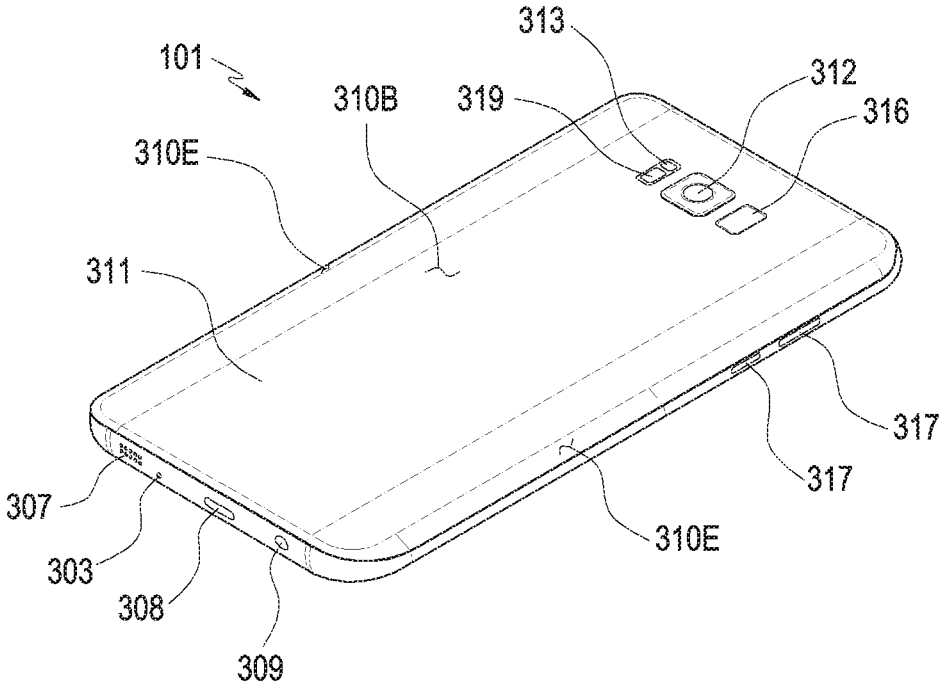
FIG. 3 is a rear side perspective view illustrating the electronic device according to various embodiments.

FIG. 2 is a front side perspective view illustrating an electronic device 101 according to various embodiments. FIG. 3 is a rear side perspective view illustrating the electronic device 101 according to various embodiments.

Referring to FIGS. 2 and 3, the electronic device 101 according to an embodiment may include a housing 310 including a first face (or a front face) 310A, a second face (or a rear face) 310B, and a side face 310C surrounding the space between the first face 310A and the second face 310B. In another embodiment (not illustrated), the term "housing" may refer to a structure forming some of the first face 310A, the second face 310B, and the side face 310C of FIG. 2. According to an embodiment, at least a portion of the first face 310A may be formed of a substantially transparent front plate 302 (e.g., a glass plate or a polymer plate including various coating layers). The second face 310B may be formed by a substantially opaque rear plate 311. The rear plate 311 may be formed of, for example, coated or colored glass, ceramic, polymer, or metal (e.g., aluminum, stainless steel (STS), or magnesium), or a combination of two or more of these materials. The side face 310C may be formed by a side bezel structure 318 (or a "side member") coupled to the front plate 302 and the rear plate 311 and including a metal and/or a polymer. In some embodiments, the rear plate 311 and the side bezel structure 318 may be integrally formed, and may include the same material (e.g., a metal material such as aluminum).

In the illustrated embodiment, the front plate 302 may include, at the long opposite side edges thereof, two first areas 310D, which are bent from the first face 310A towards the rear plate 311 and extend seamlessly. In the illustrated embodiment (see FIG. 3), the rear plate 311 may include, at the long opposite side edges thereof, two second areas 310E, which are bent from the second face 310B towards the front plate 302 and extend seamlessly. In some embodiments, the front plate 302 (or the rear plate 311) may include only one of the first areas 310D (or the second areas 310E). In another embodiment, some of the first areas 310D and the second areas 310E may not be included. In the embodiments described above, when viewed from a side of the electronic device 101, the side bezel structure 318 may have a first thickness (or width) on the side faces, which do not include the first areas 310D or the second areas 310E, and may have a second thickness (or width), which is smaller than the first thickness, on the side faces, which include the first areas 310D or the second areas 310E.

According to an embodiment, the electronic device 101 may include at least one of a display 301, audio modules 303, 307, and 314, sensor modules 304, 316, and 319, camera modules 305, 312, and 313, key input devices 317, light-emitting elements 306, and connector holes 308 and 309. In some embodiments, at least one of the components (e.g., the key input devices 317 or the light-emitting elements 306) may be omitted from the electronic device 101, or the electronic device 101 may additionally include other components.

According to an embodiment, the display 301 may be exposed through a large portion of, for example, the front plate 302. In some embodiments, at least a portion of the display 301 may be exposed through the front plate 302 forming the first face 310A and the first areas 310D of the side faces 310C. In some embodiments, the edges of the display 301 may be formed to be substantially the same as the shape of the periphery of the front plate 302 adjacent thereto. In another embodiment (not illustrated), the distance between the periphery of the display 301 and the periphery of the front plate 302 may be substantially constant in order to enlarge the exposed area of the display 301.

In another embodiment (not illustrated), a recess or an opening may be formed in a portion of the screen display area of the display 301, and at least one of the audio module 314, the sensor module 304, the camera module 305, and the light-emitting elements 306 may be aligned with the recess or the opening. In another embodiment (not illustrated), the rear face of the screen display area of the display 301 may include at least one of the audio module 314, the sensor module 304, the camera module 305, the fingerprint sensor 316, and the light-emitting elements 306. In another embodiment (not illustrated), the display 301 may be coupled to or disposed adjacent to a touch-sensitive circuit, a pressure sensor that is capable of measuring a touch intensity (pressure), and/or a digitizer that detects a magnetic-field-type stylus pen. In some embodiments, at least some of the sensor modules 304 and 519 and/or at least some of the key input devices 317 may be disposed in the first areas 310D and/or the second areas 310E.

According to an embodiment, the audio modules 303, 307, and 314 may include a microphone hole 303 and speaker holes 307 and 314. The microphone hole 303 may include a microphone disposed therein so as to acquire external sound, and in some embodiments, multiple microphones may be disposed therein so as to detect the direction of sound. The speaker holes 307 and 314 may include an external speaker hole 307 and a phone call receiver hole 314. In some embodiments, the speaker holes 307 and 314 and the microphone hole 303 may be implemented as a single hole, or a speaker may be included without the speaker holes 307 and 314 (e.g., a piezo speaker).

According to an embodiment, the sensor modules 304, 316, and 319 may generate an electrical signal or a data value corresponding to the internal operating state or the external environmental state of the electronic device 101. The sensor modules 304, 316, and 319 may include, for example, a first sensor module 304 (e.g., a proximity sensor), a second sensor module (not illustrated) (e.g., a fingerprint sensor) disposed on the first face 310A of the housing 310, a third sensor module 319 (e.g., an HRM sensor), and/or a fourth sensor module 316 (e.g., a fingerprint sensor) disposed on the second face 310B of the housing 310. The fingerprint sensor may be disposed not only on the first face 310A of the housing 310 (e.g., the display 301), but also on the second face 310B. The electronic device 101 may further include at least one of sensor modules (not illustrated) such as a gesture sensor, a gyro sensor, an atmospheric pressure sensor, a magnetic sensor, an acceleration sensor, a grip sensor, a color sensor, an infrared (IR) sensor, a biometric sensor, a temperature sensor, a humidity sensor, or an illuminance sensor.

According to an embodiment, the camera modules 305, 312, and 313 may include, for example, a first camera device 305 disposed on the first face 310A of the electronic device 101 and a second camera device 312 and/or a flash 313 disposed on the second face 310B of the electronic device 101. The camera modules 305 and 312 may include one or more lenses, an image sensor, and/or an image signal processor. The flash 313 may include, for example, a light-emitting diode or a xenon lamp. In some embodiments, two or more lenses (e.g., an infrared camera lens, a wide-angle lens, and a telephoto lens) and image sensors may be disposed on one face of the electronic device 101.

According to an embodiment, the key input devices 317 may be disposed on the side face 310C of the housing 310. In another embodiment, the electronic device 101 may not include some or all of the above-mentioned key input devices 317, and a key input device 317, which is not included in the electronic device 100, may be implemented in another form, such as that of a soft key or the like, on the display 301. In some embodiments, the key input devices may include a sensor module 316 disposed on the second face 310B of the housing 310.

According to an embodiment, the light-emitting element 306 may be disposed on, for example, the first face 310A of the housing 310. The light-emitting element 306 may provide, for example, information about the state of the electronic device 101 in an optical form. In another embodiment, the light-emitting element 306 may provide a light source that is interlocked with, for example, the operation of the camera module 305. The light-emitting element 306 may include, for example, an LED, an IR LED, and a xenon lamp.

The connector holes 308 and 309 may include a first connector hole 308 that is capable of accommodating a connector (e.g., a USB connector) for transmitting and receiving power and/or data to and from an external electronic device, and/or a second connector hole 309 that is capable of receiving a connector (e.g., an earphone jack) for transmitting and receiving an audio signal to and from an electronic device.

Figure 4:
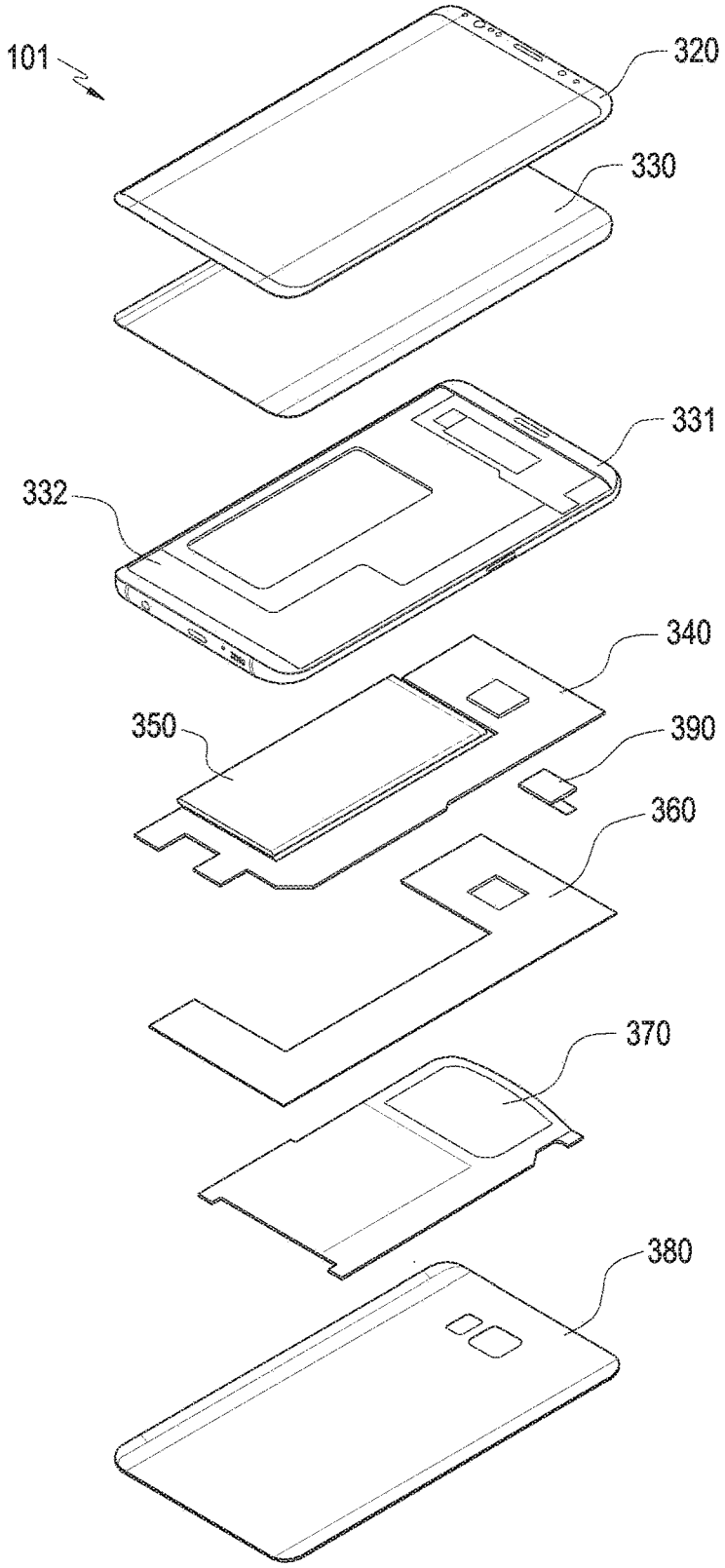
FIG. 4 is an exploded perspective view illustrating an electronic device according to various embodiments.

FIG. 4 is an exploded perspective view illustrating an electronic device 101 according to various embodiments.

Referring to FIG. 4, an electronic device 101 (e.g., the electronic device 101 in FIGS. 1 to 4) may include a side bezel structure 331, a first support member 332 (e.g., a bracket), a front plate 320, a display 330, a printed circuit board 340, a battery 350, a second support member 360 (e.g., a rear case), an antenna 370, and a rear plate 380. In some embodiments, at least one of the components (e.g., the first support member 332 or the second support member 360) may be omitted from the electronic device 101, or the electronic device 101 may additionally include other components. At least one of the components of the electronic device 101 may be the same as or similar to at least one of the components of the electronic device 101 of FIG. 4 or 5, and a redundant description thereof is omitted below.

According to an embodiment, the first support member 332 may be disposed inside the electronic device 101 so as to be connected to the side bezel structure 331, or the first support member 332 may be integrally formed with the side bezel structure 331. The first support member 332 may be formed of, for example, a metal material and/or a non-metal material (e.g., a polymer). The display 330 may be coupled to one face of the first support member 332, and the printed circuit board 340 may be coupled to the other face of the first support member 32. On the printed circuit board 340, a processor, memory, and/or an interface may be mounted. The processor may include at least one of, for example, a central processing unit (CPU), an application processor, a graphics processor, an image signal processor, a sensor hub processor, or a communication processor.

According to an embodiment, the memory may include, for example, volatile memory or nonvolatile memory.

According to an embodiment, the interface may include, for example, a high-definition multimedia interface (HDMI), a universal serial bus (USB) interface, an SD card interface, and/or an audio interface. The interface may electrically or physically connect, for example, the electronic device 101 to an external electronic device, and may include a USB connector, an SD card/an MMC connector, or an audio connector.

According to an embodiment, the battery 350 is a device for supplying power to at least one component of the electronic device 101, and may include, for example, a non-rechargeable primary battery, a rechargeable secondary battery, or a fuel cell. At least a portion of the battery 350 may be disposed on substantially the same plane as, for example, the printed circuit board 340. The battery 350 may be integrally disposed within the electronic device 101, or may be detachably mounted on the electronic device 101.

According to an embodiment, the antenna 370 may be disposed between the rear plate 380 and the battery 350. The antenna 370 may include, for example, a nearfield communication (NFC) antenna, a wireless charging antenna, and/or a magnetic secure transmission (MST) antenna. The antenna 370 may perform short-range communication with, for example, an external electronic device, or may transmit/receive power required for charging to/from the external device in a wireless manner. In another embodiment, an antenna structure may be formed by the side bezel structure 331, a portion of the first support member 332, or a combination thereof.

According to various embodiments, the electronic device may include multiple antenna modules 390. For example, some of the multiple antenna modules 390 may be implemented in order to transmit and receive radio waves having different characteristics (provisionally referred to as radio waves of frequency bands A and B) for MIMO implementation. As another example, some of the multiple antenna modules 390 may be configured, for example, to simultaneously transmit and receive radio waves having the same characteristics (provisionally referred to as radio waves having frequencies A1 and A2 in the frequency band A) for the purpose of diversity implementation. As another example, the remaining ones of the multiple antenna modules 390 may be configured, for example, to simultaneously transmit and receive radio waves having the same characteristics (provisionally referred to as radio waves having frequencies B1 and B2 in the frequency band B) for diversity implementation. In an embodiment of the disclosure, the electronic device 101 may include two antenna modules, but in another embodiment of the disclosure, the electronic device 101 may include four antenna modules so as to simultaneously implement MIMO and diversity. In still another embodiment, the electronic device 101 may include only one antenna module 390.

According to an embodiment, in consideration of the transmission/reception characteristics of radio waves, when one antenna module is disposed at a first position on the printed circuit board 340, another antenna module may be disposed at a second position, which is separated from the first position on the printed circuit board 340. As another example, one antenna module and another antenna module may be arranged in consideration of the mutual separation distance between the one antenna module and the another antenna module according to a diversity characteristic.

According to an embodiment, at least one antenna module 390 may include an RF communication circuit that processes radio waves transmitted/received in an ultra-high-frequency band (e.g., 6 GHz or higher and 300 GHz or lower). A conductive plate (e.g., one or more conductive plates 821 in FIG. 7A) of the at least one antenna module 390 may include, for example, a patch-type radiation conductor or a conductive plate having a dipole structure extending in one direction. Multiple conductive plates may be arrayed so as to form an antenna array. For example, a chip in which a part of the RF communication circuit is implemented (e.g., an integrated circuit chip) may be disposed on one side of the area in which the conductive plate is disposed or on the face that faces away from the face on which the conductive plate is disposed, and may be electrically connected to the conductive plate via wiring made of a printed circuit pattern.

Figure 5:
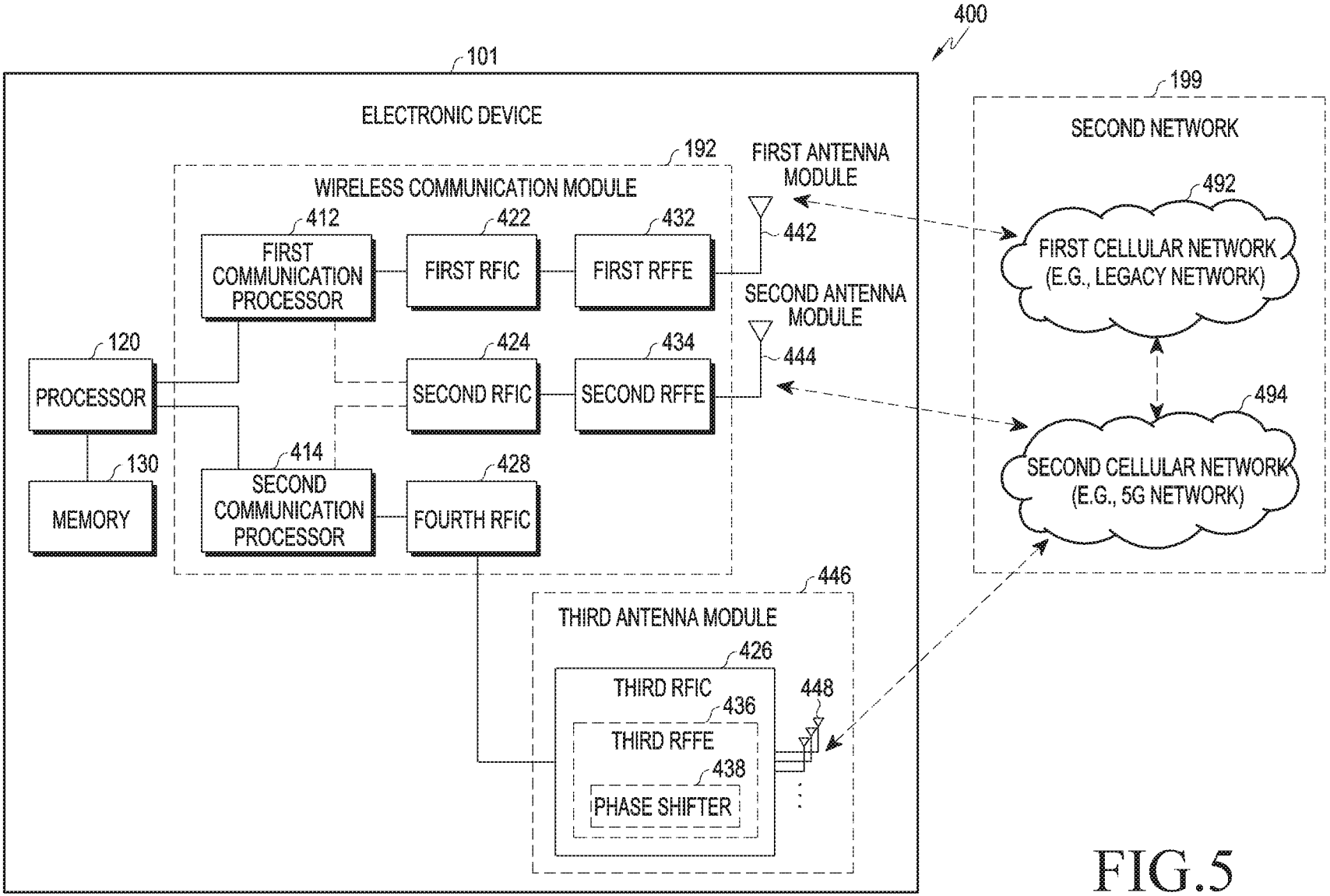
FIG. 5 is a block diagram of an electronic device according to various embodiments in a network environment including multiple cellular networks.

FIG. 5 is a block diagram 400 of an electronic device 101 according to various embodiments in a network environment including multiple cellular networks.

Referring to FIG. 5, the electronic device 101 may include a first communication processor 412, a second communication processor 414, a first radio-frequency integrated circuit (RFIC) 422, a second RFIC 424, a third RFIC 426, a fourth RFIC 428, a first radio-frequency front end (RFFE) 432, a second RFFE 434, a first antenna module 442, a second antenna module 444, and an antenna 448. The electronic device 101 may further include a processor 120 and memory 130. The second network 199 may include a first cellular network 492 and a second cellular network 494. According to another embodiment, the electronic device 101 may further include at least one of the components illustrated in FIG. 2, and the second network 199 may further include one or more other networks. According to an embodiment, the first communication processor 412, the second communication processor 414, the first RFIC 422, the second RFIC 424, the fourth RFIC 428, the first RFFE 432, and the second RFFE 434 may form at least a part of an RF communication module 192. According to another embodiment, the fourth RFIC 428 may be omitted, or may be included as part of the third RFIC 426.

According to various embodiments, the first communication processor 412 may establish a communication channel in a band to be used for RF communication with the first cellular network 492, and may support legacy network communication via the established communication channel. According to various embodiments, the first cellular network may be a legacy network including a second-generation (4G), 3G, 4G, or long-term evolution (LTE) network. The second communication processor 414 may establish a communication channel corresponding to a designated band (e.g., about 6 GHz to about 60 GHz) in a band to be used for RF communication with the second cellular network 494, and may support 5G network communication via the established communication channel. According to various embodiments, the second cellular network 494 may be a 5G network defined in the 3GPP. In addition, according to an embodiment, the first communication processor 412 or the second communication processor 414 may establish a communication channel corresponding to another designated band (e.g., about 6 GHz or lower) in the band to be used for RF communication with the second cellular network 494, and may support 5G network communication through the established communication channel. According to an embodiment, the first communication processor 412 and the second communication processor 414 may be implemented in a single chip or in a single package. According to various embodiments, the first communication processor 412 or the second communication processor 414 may be formed in a single chip or a single package with the processor 120, an auxiliary processor 123, or a communication module 190.

According to an embodiment, during transmission, the first RFIC 422 may convert a baseband signal generated by the first communication processor 412 into an RF signal of about 700 MHz to about 3 GHz to be used in the first cellular network 492 (e.g., a legacy network). During reception, an RF signal may be acquired from the first cellular network 492 (e.g., the legacy network) through an antenna (e.g., the first antenna module 442), and may be pre-processed through an RFFE (e.g., the first RFFE 432). The first RFIC 422 may convert the pre-processed RF signal into a baseband signal to be processed by the first communication processor 412.

According to an embodiment, during transmission, the second RFIC 424 may convert the baseband signal generated by the first communication processor 412 or the second communication processor 414 into an RF signal in a Sub6 band (e.g., about 6 GHz or lower) (hereinafter, referred to as "5G sub6 RF signal") to be used in the second cellular network 494 (e.g., a 5G network). During reception, the 5G Sub6 RF signal may be acquired from the second cellular network 494 (e.g., a 5G network) through an antenna (e.g., the second antenna module 444), and may be pre-processed through an RFFE (e.g., the second RFFE 434). The second RFIC 424 may convert the pre-processed 5G Sub6 RF signal into a baseband signal so as to be processed by a corresponding one of the first communication processor 412 and the second communication processor 414.

According to an embodiment, the third RFIC 426 may convert the baseband signal generated by the second communication processor 414 into an RF signal in a 5G Above6 band (e.g., about 6 GHz to about 60 GHz) (hereinafter, referred to as a "5G Above6 RF signal") to be used in the second cellular network 494 (e.g., a 5G network). During reception, the 5G Above6 RF signal may be acquired from the second cellular network 494 (e.g., a 5G network) through an antenna (e.g., the second antenna module 448), and may be pre-processed through the third RFFE 436. The third RFIC 426 may convert the pre-processed 5G Above6 RF signal into a baseband signal to be processed by the second communication processor 414. According to an embodiment, the third RFFE 436 may be formed as a part of the third RFIC 426.

According to an embodiment, the electronic device 101 may include a fourth RFIC 428 separately from or as at least a part of the third RFIC 426. In this case, the fourth RFIC 428 may convert the baseband signal generated by the second communication processor 414 into an RF signal (hereinafter, referred to as an "IF signal") in an intermediate frequency band (e.g., about 9 GHz to about 11 GHz), and may then deliver the IF signal to the third RFIC 426. The third RFIC 426 may convert the IF signal into a 5G Above6 RF signal. During reception, the 5G Above6 RF signal may be acquired from the second cellular network 494 (e.g., a 5G network) through an antenna (e.g., the antenna 448), and may be converted into an IF signal through the third RFIC 426. The fourth RFIC 428 may convert the IF signal into a baseband signal to be capable of being processed by the second communication processor 414.

According to an embodiment, the first RFIC 422 and the second RFIC 424 may be implemented as at least a part of a single chip or a single package. According to an embodiment, the first RFFE 432 and the second RFFE 434 may be implemented as at least a part of a single chip or a single package. According to an embodiment, at least one of the first antenna module 442 and the second antenna module 444 may be omitted, or may be combined with another antenna module so as to process RF signals of multiple corresponding bands.

According to an embodiment, the third RFIC 426 and the antenna 448 may be disposed on the same substrate so as to form a third antenna module 446. For example, the RF communication module 192 or the processor 120 may be placed on a first substrate (e.g., a main PCB). In such a case, the third RFIC 426 may be disposed on a partial area (e.g., a lower face) of a second substrate (e.g., a sub-PCB) separate from the first substrate, and the antenna 448 may be disposed on another partial area (e.g., an upper face), thereby forming the third antenna module 446. By disposing the third RFIC 426 and the antenna 448 on the same substrate, it is possible to reduce the length of the transmission line therebetween. Through this, it is possible to reduce the loss (e.g., attenuation) of a signal in an RF band (e.g., about 6 GHz to about 60 GHz) to be used for, for example, 5G network communication by the transmission line. As a result, the electronic device 101 is able to improve the quality or speed of communication with the second cellular network 494 (e.g., a 5G network).

According to an embodiment, the antenna 448 may be formed as an antenna array that includes multiple antenna elements capable of being used for beamforming. In this case, the third RFIC 426 may include multiple phase converters 438 corresponding to the multiple antenna elements, for example, as a part of the third RFFE 436. During transmission, each of the multiple phase converters 438 may convert the phase of a 5G Above6 RF signal to be transmitted to the outside of the electronic device 101 (e.g., a base station of a 5G network) through a corresponding antenna element. During reception, each of the multiple phase converters 438 may convert the phase of the 5G Above6 RF signal received from the outside into the same or substantially the same phase through the corresponding antenna element. This enables transmission or reception through beamforming between the electronic device 101 and the outside.

According to various embodiments, the second cellular network 494 (e.g., a 5G network) may be operated independently from the first cellular network 492 (e.g., a legacy network) (e.g., Stand Alone (SA)), or may be operated in the state of being connected to the first cellular network 292 (e.g., Non-Stand Alone (NSA)). For example, in a 5G network, only an access network (e.g., a 5G radio access network (RAN) or a next-generation RAN (NG RAN)) may exist, but a core network (e.g., a next-generation core (NGC)) may not exist. In this case, after accessing the access network of the 5G network, the electronic device 101 may access an external network (e.g., the Internet) under the control of the core network (e.g., an evolved packed core (EPC)) of a legacy network. Protocol information for communication with a legacy network (e.g., LTE protocol information) or protocol information for communication with a 5G network (e.g., new radio (NR) protocol information) may be stored in the memory 430, and may be accessed by another component (e.g., the processor 120, the first communication processor 412, or the second communication processor 414).

Figure 6A:
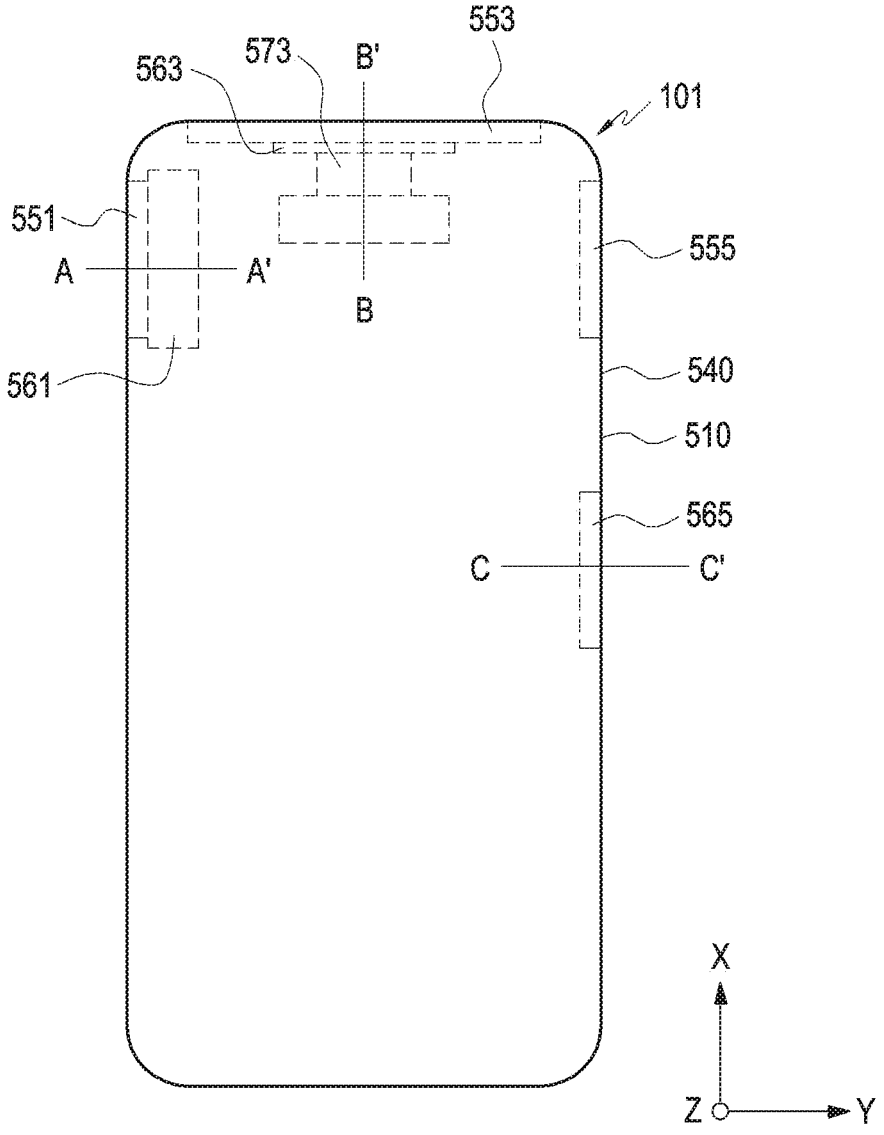
FIGS. 6A, 6B, 6C, and 6D are a view illustrating an embodiment of a structure of the electronic device illustrated in FIG. 5.
Figure 6B:
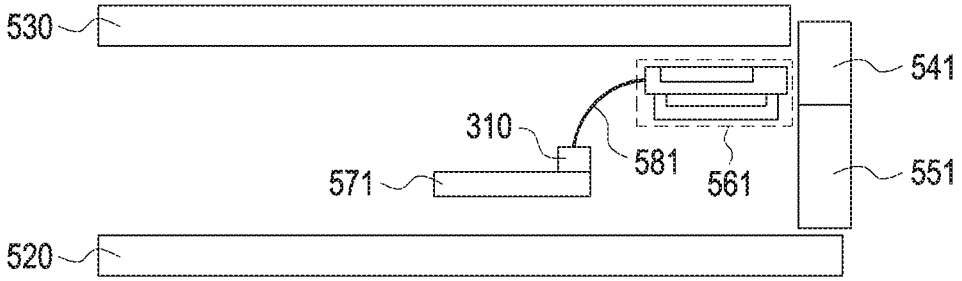
Figure 6C:
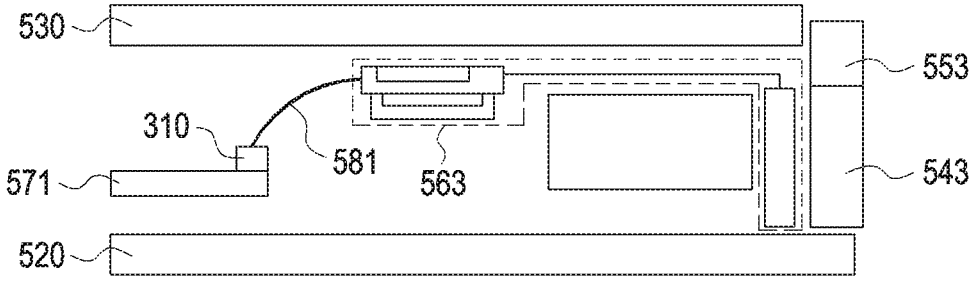
Figure 6D:
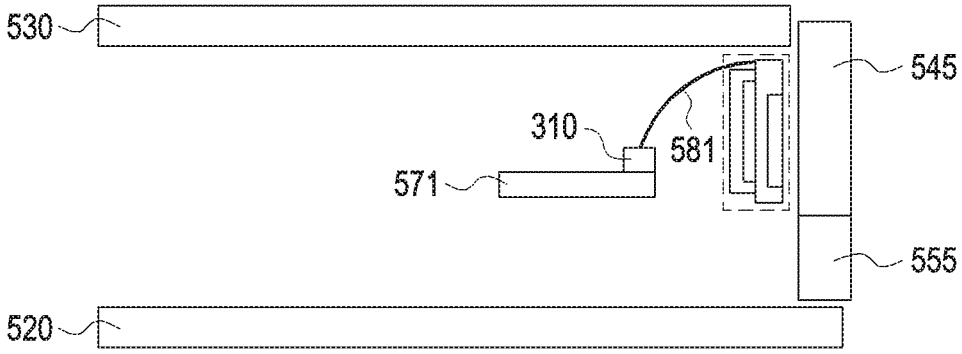

FIG. 6A is a view illustrating an embodiment of the structure of the electronic device illustrated in FIG. 5, FIG. 6B is a cross-sectional view taken along line A-A' in FIG. 6A, FIG. 6C is a cross-sectional view taken along line B-B' in FIG. 6A, and FIG. 6D is a cross-sectional view taken along line C-C in FIG. 6D.

Referring to FIGS. 6A to 6D, the electronic device 101 may include a housing 310 including a first plate 520 (e.g., a front plate), a second plate (e.g., a rear plate or a rear glass) spaced apart from the first plate and facing away from the first plate 520, and a side member 540 surrounding the space between the first plate 520 and the second plate 530.

According to an embodiment, the first plate 520 may include a transparent material including glass plate. The second plate 530 may include a non-conductive material and/or a conductive material. In addition, the side member 540 may include a conductive material and/or a non-conductive material. In some embodiments, at least a portion of the side member 540 may be formed integrally with the second plate 530. In the illustrated embodiment, the side member 540 may include first to third insulating portions 541, 543, and 545 and first to third conductive portions 551, 553, and 555.

According to an embodiment, within the space, the electronic device 101 may include a display disposed to be visible through the first plate 520, a main printed circuit board (PCB) 571, and/or a mid-plate (not illustrated), and may optionally further include various other components.

According to an embodiment, the electronic device 101 may include a first legacy antenna 551, a second legacy antenna 553, and a third legacy antenna 555 in the space and/or on a portion of the housing 310 (e.g., the side member 540). The first to third legacy antennas 551, 553, and 555 may be used for, for example, cellular communication (e.g., 2nd-generation (2G), 3G, 4G, or LTE), nearfield communication (e.g., Wi-Fi, Bluetooth, or NFC), and/or global navigation satellite system (GNSS).

According to an embodiment, the electronic device 101 may include a first antenna module 561, a second antenna module 563, and a third antenna module 565 for forming a directional beam. The antenna modules 561, 563, and 565 may be used for 5G network (e.g., the second cellular network 494 in FIG. 5) communication, mmWave communication, 60 GHz communication, or WiGig communication. The antenna modules 561, 563, and 565 may be disposed in the housing so as to be spaced apart from metal members of the electronic device 101 (e.g., the housing 310, an internal component 573, and/or the first to third legacy antennas 551, 553, and 555) by a predetermined interval or more.

In the illustrated embodiment, the first antenna module 561 may be located at the upper end of the left side (−Y axis), the second antenna module 563 may be located at the middle of the upper end (X axis), and the third antenna module 565 may be located at the middle of the right side (Y axis). In another embodiment, the electronic device 101 may include additional antenna modules at additional positions (e.g., at the middle of the lower end (−X axis)), or some of the first to third antenna modules 561, 563, and 565 may be omitted. According to an embodiment, the first to third antenna modules 561, 563, and 565 may be electrically connected to at least one communication processor (e.g., the processor 120 in FIG. 5) on a main PCB 571 using a conductive line 581 (e.g., a coaxial cable or an FPCB).

Referring to FIG. 6B, which illustrates a cross section taken along line A-A' in FIG. 6A, some (e.g., a patch antenna array) of the antenna arrays of the first antenna module 561 may be disposed to emit radiation toward the second plate 530, and remaining ones (e.g., a dipole antenna array) of the antenna arrays of the first antenna module 561 may be disposed to emit radiation through the first insulating portion 541. Referring to FIG. 6C, which illustrates a cross section taken along line B-B' in FIG. 6A, some (e.g., a patch antenna array) of the radiators of the second antenna module 563 may be disposed to emit radiation toward the second plate 530, and remaining ones (e.g., a dipole antenna array) of the radiators of the first antenna module 561 may be disposed to emit radiation through the second insulating portion 543.

In the illustrated embodiment, the second antenna module 563 may include multiple printed circuit boards. For example, some (e.g., a patch antenna array) of the antenna arrays and remaining ones (e.g., a dipole antenna array) of the antenna arrays may be located on different printed circuit boards. According to an embodiment, the printed circuit boards may be connected via a flexible printed circuit board. The flexible printed circuit board may be disposed in the vicinity of electrical components 573 (e.g., a receiver, a speaker, sensors, a camera, an ear jack, or a button).

Referring to FIG. 6D, which illustrates a cross section taken along line C-C' in FIG. 6A, the third antenna module 565 may be disposed to face the side member 540 of the housing 310. Some (e.g., a dipole antenna array) of the antenna arrays of the third antenna module 565 may be disposed to emit radiation toward the second plate 530, and remaining ones (e.g., a patch antenna array) of the antenna arrays of the third antenna module 561 may be disposed to emit radiation through the third insulating portion 545.

Figure 7A:
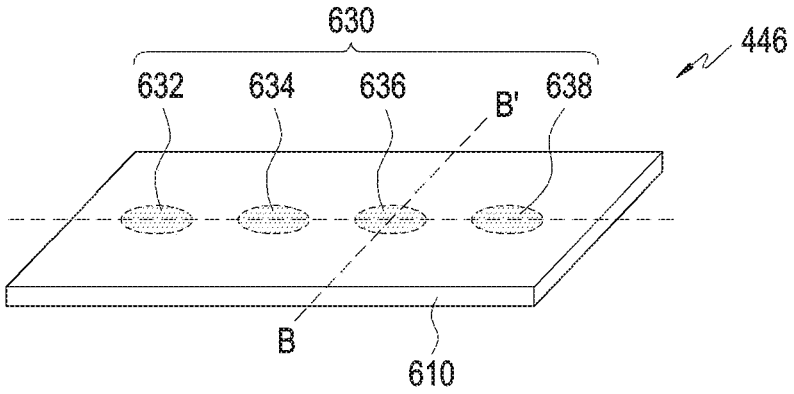
FIGS. 7A, 7B, and 7C are views illustrating an embodiment of a structure of the third antenna module 446 described with reference to FIG. 5.
Figure 7B:
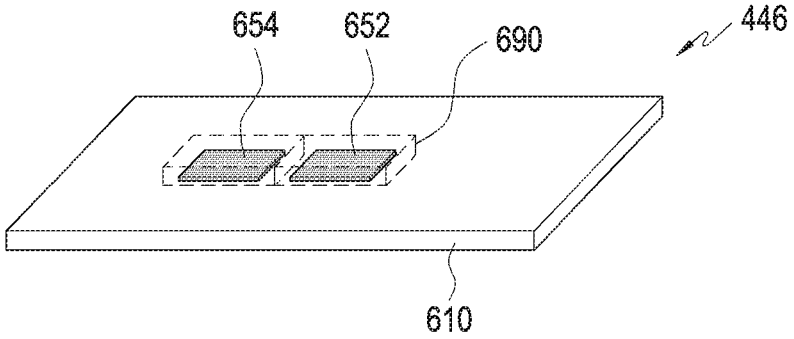
Figure 7C:
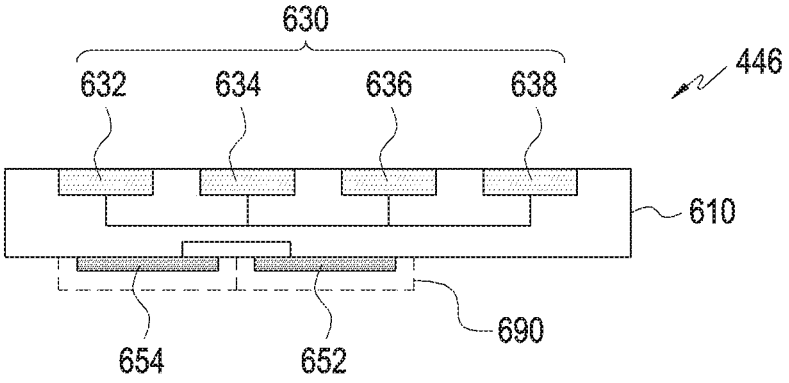

FIGS. 7A to 7C are views illustrating an embodiment of the structure of the third antenna module 446 described with reference to FIG. 5. FIG. 7A is a perspective view of the third antenna module 446 viewed from one side, FIG. 7B is a perspective view of the third antenna module 446 viewed from the other side, and FIG. 7C is a cross-sectional view of the third antenna module 446, taken along line A-A'.

Referring to FIGS. 7A to 7C, in an embodiment, the third antenna module 446 may include a printed circuit board 610, an antenna array 630, a radio-frequency integrated circuit (RFIC) 652, a power management integrated circuit (PMIC) 654, and a module interface 670. Optionally, the third antenna module 446 may further include a shield member 690. In other embodiments, at least one of the above-mentioned components may be omitted, or at least two of the components may be integrally formed.

According to an embodiment, the printed circuit board 610 may include multiple conductive layers and multiple non-conductive layers stacked alternately with the conductive layers. The printed circuit board 610 may provide an electrical connection between various electronic components mounted on the printed circuit board 610 and/or various electronic components disposed outside the printed circuit board 610 using wiring lines and conductive vias formed in the conductive layers.

According to an embodiment, an antenna array 630 (e.g., the antenna 448 in FIG. 4) includes multiple antenna elements 632, 634, 636, and 638 arranged to form directional beams. As illustrated, the antenna elements may be formed on a first face of the printed circuit board 610. According to another embodiment, the antenna array 630 may be formed inside the printed circuit board 610. According to embodiments, the antenna array 630 may include multiple antenna arrays, which are different or the same in shape or type (e.g., dipole antenna arrays and/or patch antenna arrays).

According to an embodiment, the RFIC 652 (e.g., the third RFIC 426 in FIG. 4) may be disposed in another area of the printed circuit board 610 spaced apart from the antenna array (e.g., on the second face opposite the first face). The RFIC is configured to be capable of processing signals in a selected frequency band transmitted/received through the antenna array 630. According to an embodiment, during transmission, the RFIC 652 may convert a baseband signal acquired from a communication processor (not illustrated) into an RF signal in a designated band. During reception, the RFIC 652 may convert an RF signal received through the antenna array 652 into a baseband signal and transmit the baseband signal to a communication processor.

According to another embodiment, during transmission, the RFIC 652 may up-convert an IF signal (of, e.g., about 9 GHz to about 11 GHz) acquired from an intermediate-frequency integrated circuit (IFIC) into an RF signal of a selected band. During reception, the RFIC 652 may down-convert an RF signal acquired through the antenna array 652 into an IF signal and transmit the IF signal to the IFIC.

According to an embodiment, the PMIC 654 may be disposed in another partial area (e.g., the second face) of the printed circuit board 610 spaced apart from the antenna array. The PMIC may receive a voltage from a main PCB (not illustrated) and provide required power for various components (e.g., the RFIC 652) on the antenna module.

According to an embodiment, the shield member 690 may be disposed on a portion (e.g., the second face) of the printed circuit board 610 so as to electromagnetically shield at least one of the RFIC 652 or the PMIC 654. According to an embodiment, the shield member 690 may include a shield can.

Although not illustrated, in various embodiments, the third antenna module 446 may be electrically connected to another printed circuit board (e.g., a main circuit board) via a module interface. The module interface may include a connecting member, such as a coaxial cable connector, a board-to-board connector, an interposer, or a flexible printed circuit board (FPCB). Through the connection member, the RFIC 652 and/or the PMIC 654 of the antenna module may be electrically connected to the printed circuit board.

Figure 8:
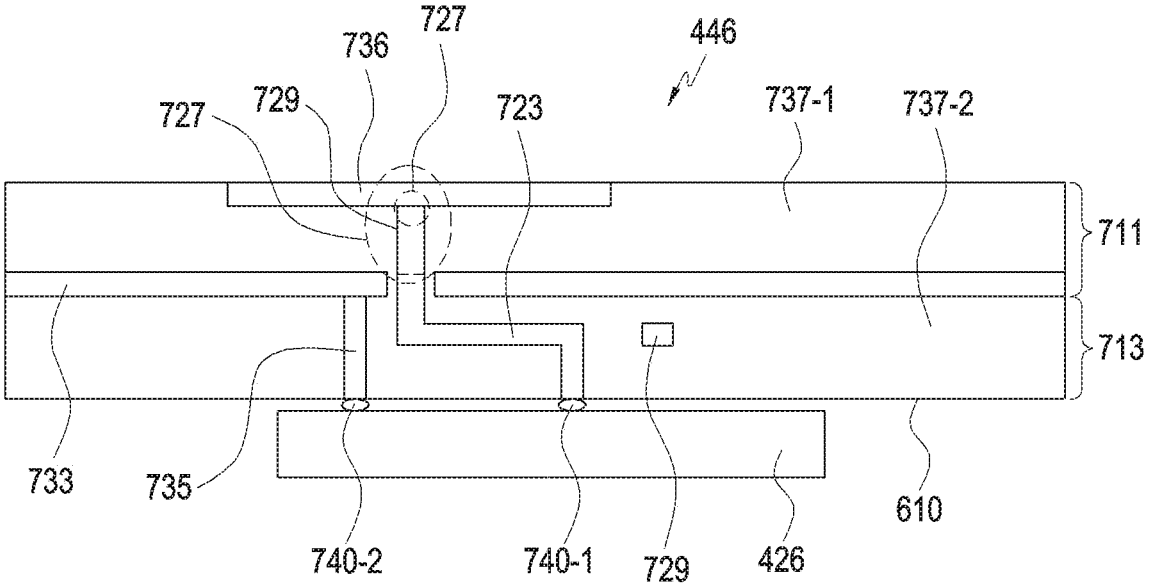
FIG. 8 is a cross-sectional view illustrating an antenna module according to various embodiments.

FIG. 8 is a cross-sectional view illustrating an antenna module 800 according to various embodiments.

Referring to FIG. 8, a printed circuit board 510 may include an antenna layer 711 and a network layer 713.

According to various embodiments, the antenna layer 711 may include at least one dielectric layer 737-1 as well as an antenna element 736 and/or a power feeder 725 formed on the outer surface of the dielectric layer 737-1 or inside the dielectric layer 737-1. The power feeder 725 may include a power feeding point 727 and/or a power feeding line 729.

According to various embodiments, the network layer 713 may include at least one dielectric layer 737-2, at least one ground layer 733 formed on the outer surface of the dielectric layer 737-2 or the inside of the dielectric layer 732-7, at least one conductive via 735, a transmission line 723, and/or a signal line 729.

According to various embodiments, the third RFIC 426 (e.g., the third RFIC 426 in FIG. 5) may be electrically connected to the network layer 713 via, for example, first and second connection portions (solder bumps) 740-1 and 540-2. In other embodiments, various connection structures (e.g., solder or BGA) may be used instead of the connection portions. The third RFIC 426 may be electrically connected to the antenna element 736 via the first connection portion 740-1, the transmission line 723, and the power feeder 725. The third RFIC 426 may be electrically connected to the ground layer 733 via the second connection portion 740-2 and the conductive via 735. Although not illustrated, the third RFIC 426 may be electrically connected to the above-mentioned module interface via the signal line 729.

Figure 9A:
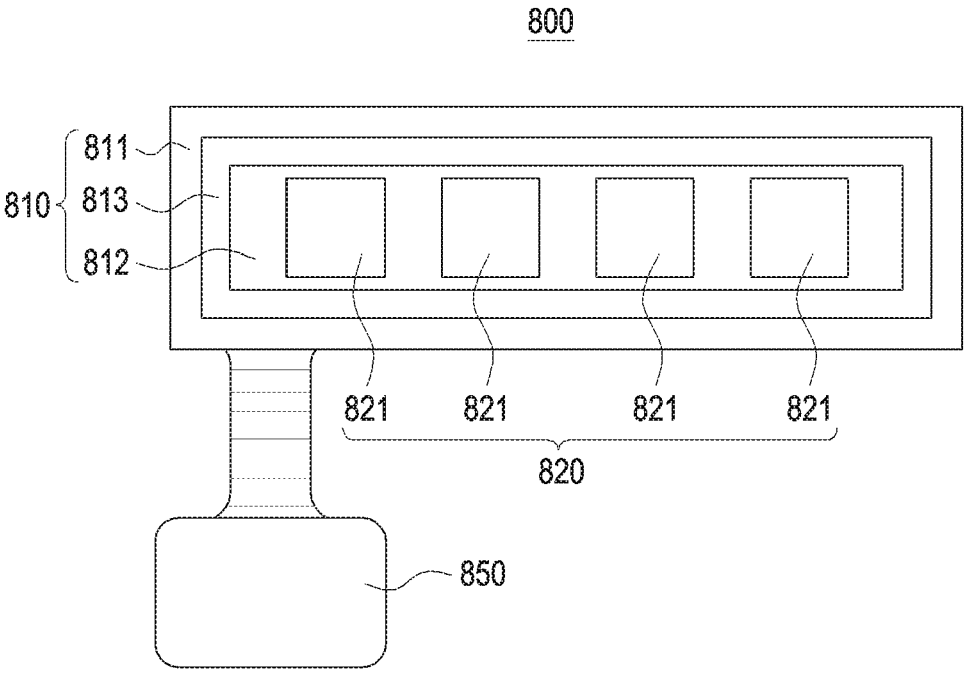
FIG. 9A is a plan view of an antenna module disposed inside an electronic device according to various embodiments.
Figure 9B:
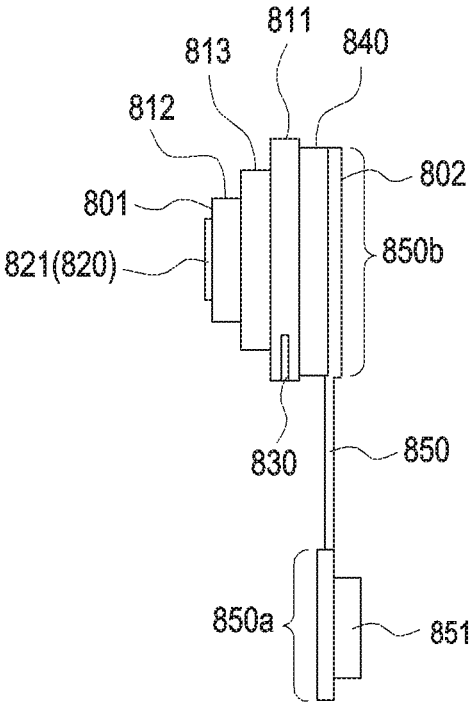
FIG. 9B is a side view of the antenna module according to various embodiments.

FIG. 9A is a top plan view of an antenna module 800 disposed inside an electronic device according to various embodiments, and FIG. 9B is a side view of the antenna module 800 according to various embodiments.

Referring to FIGS. 9A and 9B, the antenna module 800 may be located in the internal space of an electronic device (e.g., the electronic device 101 in FIGS. 1 to 5). The configuration of the antenna module 800 of FIGS. 9A and 9B may be partially or wholly the same as the configuration of at least one of the antenna module 390 in FIG. 4, the first to third antenna modules 442, 444, and 446 of FIG. 5 and the configuration of the antenna disposed on the printed circuit board 510 in FIG. 6A.

The antenna module 800 may include a board 810 provided with multiple conductive layers and an antenna radiator disposed on one face of the board 810 or inside the board 810 as well as an RF communication circuit 840 and a bridge circuit board 850 facing the board and electrically connected to each other.

According to an embodiment, the antenna module 800 may include a first face 801 and a second face 802 that faces away from the first face 801. For example, the antenna module 800 may include a structure in which the RF communication circuit 840 and the bridge circuit board 850 are sequentially stacked with reference to the multiple conductive layers constituting the board 810. When layers are stacked in the board 810 from a first layer, which is the lowermost layer, to an nth layer, the outer face of the nth layer may be the first face 801, and one face of the bridge circuit board 850 may be the second face 802.

According to various embodiments, the conductive layers constituting the board 810 may form build-up layers, of which areas decrease toward the upper layer. For example, the board 810 may include a first layer forming the lowermost layer and having a first area 811 and a second layer 812 having a second layer smaller than the first area and stacked on the first layer 811.

According to still another embodiment, the board 810 may include a first layer forming the lowermost layer and having a first area 811, a third layer 813 having a third area smaller than the first area and stacked on the first layer 811, and a second layer 812 having a second area smaller than the third area and stacked on the third layer 813. However, the number of stacked conductive layers of the board 810 is not limited to two or three layers, and may be four or more when a design change is made.

According to various embodiments, the antenna radiator may include at least one first conductive element 820 or at least one second conductive element 830. The first conductive element 820 and the second conductive element 830 may include antenna types of various structures. For example, the first conductive element 820 may be a patch type antenna, and the second conductive element 830 may be a dipole type antenna. As another example, the first conductive element 820 may be a dipole antenna, and the second conductive element 830 may be a dipole antenna.

According to an embodiment, the first conductive element 820 and the second conductive element 830 may be disposed on the board 810. For example, the first conductive element 820 may be disposed on the second layer 812 of the board 810, in which three conductive layers are stacked, and the second conductive element 830 may be disposed on the first layer 811. Since no antenna radiator is disposed on the third layer 813 between the first layer 811 and the second layer 812, it is possible to secure a separation distance between the first conductive element 820 and the second conductive element 830, and to provide a radiation utilization area of the second conductive element 830, which emits radiation to the side area.

According to various embodiments, the first conductive element 820 may be disposed on the front face (e.g., the first face 801) of the antenna module 800 or inside the antenna module 800. The first conductive element 820 may include one or more first conductive plates 821. The conductive plates 821 may be made of, for example, a patch-type radiation conductor. When two or more conductive plates are provided, the conductive plates may be arrayed to form a designated pattern, thereby forming an antenna array. A chip (e.g., an integrated circuit chip), in which a part of the RF communication circuit 840 is implemented, may be disposed on one side of the area where the conductive plates 821 are disposed or on a face that faces away from the face on which the conductive plates 821 are disposed.

According to an embodiment, the conductive plates 821 are disposed on one face of the conductive layer (e.g., the second layer 812) forming the uppermost layer in the board 810, and protrudes to a predetermined thickness. However, the disclosure is not limited thereto, and each of the conductive plates may be formed in a thin plate shape on the one face or may be disposed in an opened conductive layer such that the conductive plate does not protrude on the outer face of the board.

According to an embodiment, the conductive plates 821 may be electrically connected with a power feeder (not illustrated) of a circuit board (e.g., the printed circuit board 340 in FIG. 4) so as to transmit and receive an RF signal in at least one frequency band. For example, the power feeder may be electrically connected to the multiple conductive plates 821, and may apply a signal current so as to supply an RF signal, or may receive another RF signal through the conductive plates 821.

The second conductive element 830 may be disposed between the first face 801 and the second face 802 of the antenna module 800, and may be disposed to be oriented in a direction different from the direction in which the first conductive element 820 is oriented. The second conductive element 830 may include one or more conductive conductors. The conductive conductors may be made of, for example, a radiation conductor having a dipole structure extending in one direction. When multiple radiation conductors are provided, the conductive plates may be arrayed to form a designated pattern, thereby forming an antenna array.

According to an embodiment, the radiation conductors of the second conductive element 830 may be electrically connected with a power feeder (not illustrated) of a circuit board (e.g., the printed circuit board 340 in FIG. 4) so as to transmit and receive an RF signal in at least one frequency band.

According to various embodiments, the RF communication circuit 840 may be electrically connected to the antenna module 800, and may receive a communication signal having a designated frequency or transmit a received communication signal through a radio transceiver. The RF communication circuit 840 may include the configuration of the third RFIC 426 of FIG. 5. For example, the RF communication circuit 840 may perform RF communication using the first conductive element 820 or the second conductive element 830 while being controlled by a processor (e.g., the processor 120 in FIG. 5). In another embodiment, the RF communication circuit 840 may receive a control signal and power from the processor 120 and the power management module (e.g., the power management module 188 in FIG. 1), and may process a communication signal received from the outside or a communication signal to be transmitted to the outside. For example, the RF communication circuit 840 may include a switch circuit for separating transmission/reception signals as well as various amplifiers and filter circuits for improving transmission/reception signal quality.

According to an embodiment, when the multiple conductive plates or radiation conductors form an antenna array, the RF communication circuit 840 may include a phase shifter connected to each conductive plate or radiation conductor, thereby controlling the direction in which the communication device, for example, the electronic device 101 is oriented. For example, when the electronic device 101 includes an antenna array, the RF communication circuit 840 may provide phase difference power feeding to each radiation conductor so as to control the directivity of the communication device or the electronic device (e.g., the electronic device 101 in FIG. 1) equipped with the communication device. This phase difference power feeding may be useful for ensuring an optimal communication environment or a good communication environment in a communication method having a strong rectilinear advancing property, such as mm wave communication (e.g., RF communication using a frequency band of about 6 GHz or higher and about 300 GHz or lower).

According to an embodiment, the RF communication circuit 840 may be stacked on the rear face of the board 810. A shield member (not illustrated) may be disposed in a peripheral portion of the RF communication circuit 840 so as to shield the RF communication circuit 840. The shield member is capable of blocking EMI, and may provide a path such that heat generated by the RF communication circuit 840 is transferred to a bracket (e.g., the bracket 332 in FIG. 11) or a heat radiation member (e.g., a heat radiation member 920 or 730 in FIGS. 10A and 10B). In addition to the shield member, components disposed to surround the RF communication circuit 840 may be various modified in design for EMI blocking and/or efficient heat conduction.

According to various embodiments, the antenna module 800 may include a bridge circuit board 850 connected to the RF communication circuit 840. The bridge circuit board 850 may include a first area 850*a* and a second area 850*b* extending from the first area 850*a* through the bridge area, and the board 810 and the RF communication circuit 840 may be disposed on the first area 850. The second area 850*b* may include a connector (e.g., a coaxial cable connector or a board-to-board (B-to-B)) 851 connecting a signal from the RF communication circuit 840 to a main circuit board (e.g., the printed circuit board 340 in FIG. 4). The board 810 and the RF communication circuit 840 disposed in the first area 850*a* may be disposed to face away from the connector 851 disposed in the second area 850*b*.

According to an embodiment, the bridge circuit board 850 may be connected to a main circuit board (e.g., the printed circuit board in FIG. 4) having an RF communication module (e.g., the RF communication module 192 in FIG. 5) disposed thereon using, for example, a coaxial cable connector, and the coaxial cable may be used to transfer a transmitted or received IF signal or an RF signal. As another example, power or other control signals may be transferred through the B-to-B connector.

Figure 10A:
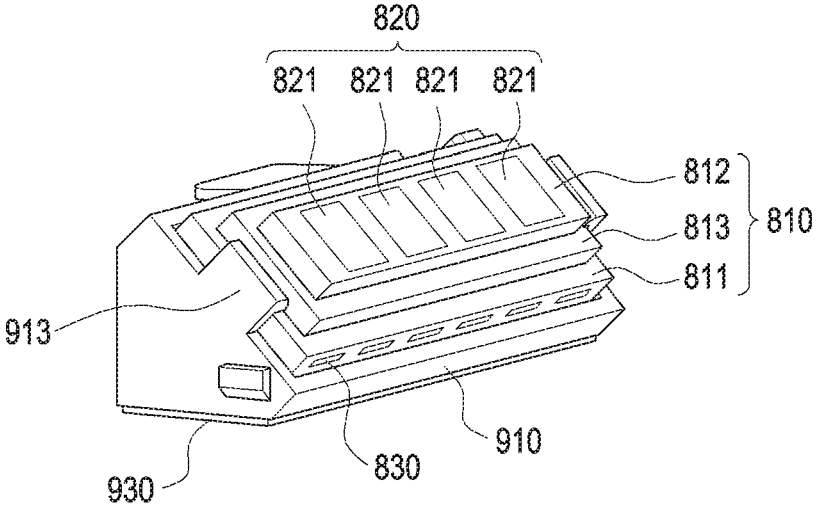
FIG. 10A is a perspective view illustrating the state in which an antenna module is mounted in an antenna housing according to various embodiments.
Figure 10B:
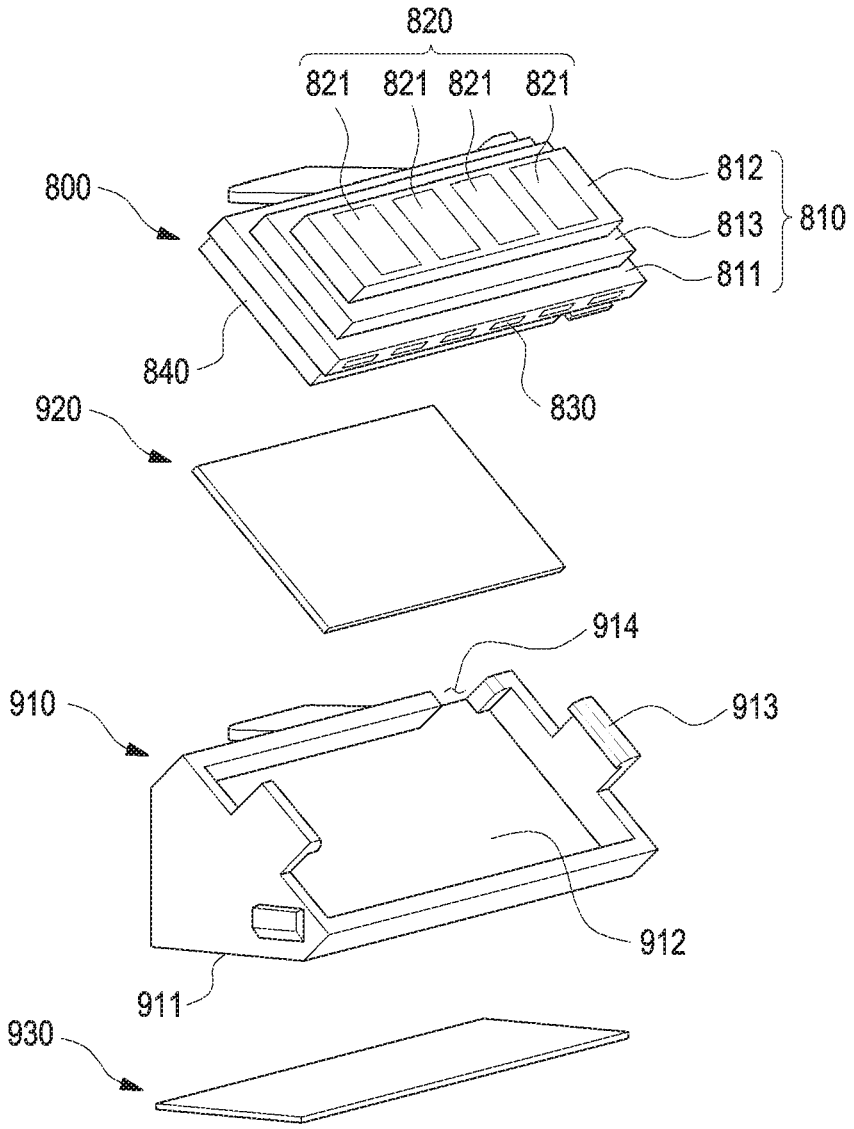
FIG. 10B is an exploded perspective view illustrating an antenna module and a heat dissipation member before being mounted in an antenna housing according to various embodiments.

FIG. 10A is a perspective view illustrating the state in which the antenna module 800 is mounted in an antenna housing 910 according to various embodiments. FIG. 10B is an exploded perspective view illustrating the antenna module 800 and a heat dissipation member 920 or 730 before being mounted in the antenna housing 910 according to various embodiments.

Referring to FIGS. 10A and 10B, the antenna module 800 may be located in an internal space of an electronic device (e.g., the electronic device 101 in FIGS. 1 to 5), and the antenna module 800 may be modularized and mounted in the electronic device 101, and may be mounted within the antenna housing 910 in order to provide a radiation area in a designated direction.

According to various embodiments, the electronic device 101 may include the antenna module 800, the antenna housing 910 in which the antenna module 800 is mounted, and a heat dissipation member 920 or 930 disposed between the antenna housing 910 and the antenna module or on one side of the antenna housing 910.

According to various embodiments, the antenna module 800 may include the board 810, first and second conductive elements 820 and 830, and an RF communication circuit 840. The description of the configurations of the board 810, the first and second conductive elements 820 and 830, and the RF communication circuit 840 of the antenna module 800 of FIGS. 9A and 9B may be applicable to the configurations of the board 810, the first and second conductive elements 820 and 830, and the RF communication circuit 840 of the antenna module 800 of FIGS. 10A and 10B.

According to various embodiments, the antenna housing 910 may be fixed inside the electronic device 101 in the state in which the antenna module 800 is mounted thereon. The antenna housing 910 may include at least one fixing member (e.g., a hook or a screw) in order to fix the antenna housing 910 inside the electronic device 101. However, the shape for fixing the antenna housing 910 to the electronic device is not limited, and the antenna housing 910 may be fixed to one face of the electronic device 101, with which the antenna housing 910 comes into contact, through bonding or via an adhesive sheet such as tape.

According to an embodiment, the antenna housing 910 may be formed as an integral injection-molded product, and may include a fixing face 911 facing one face of the electronic device 101, a seating face 912 on which the antenna module 800 is seated, or coupling members 913 for fixing the seated antenna module 800. The fixing face 911 may be in contact with an inner portion of the electronic device 101 so as to support the antenna housing 910. The seating face 912 may be provided in a groove shape, which is recessed inward, and may have a designated slope. Accordingly, at least a portion of the antenna module 800 may be inserted and disposed to have the slope in a designated direction. The coupling members 913 may be formed to protrude from opposite sides of the seating face 912 so that opposite ends of the antenna module 800 disposed on the seating face may be fitted to the coupling members 913. For example, the coupling members 913 may be provided in a hook shape so as to be coupled to opposite ends of the first layer 811 of the antenna module 800.

According to an embodiment, an opening 914 may be provided at one side of the seating face 912 of the antenna housing 910 so as to provide a passage in which the bridge circuit board (e.g., the bridge circuit board 850 in FIG. 7B)

of the antenna module 800 extends. As another example, the antenna housing 910 may be made of a heat-dissipating material so as to be capable of dissipating heat itself. For example, the antenna housing 910 may be manufactured to include a material having high thermal conductivity, such as copper (Cu), aluminum (Al), or gold (Au). As another example, the antenna housing 910 may be implemented by being plated with a metal material having high thermal conductivity, or through insert injection molding of the above-mentioned metal materials. However, the structure for heat dissipation of the antenna module 800 is not limited to those described above. The antenna housing 910 may be formed of a printed circuit board, and the printed circuit board may include fine holes capable of transferring heat emitted from the antenna module 800.

According to various embodiments, a heat dissipation member 920 or 930 may be disposed on one face of the antenna housing 910 so as to guide the diffusion of heat emitted from the antenna module 800. The heat dissipation member 920 or 930 may include a first heat dissipation member 920 and a second heat dissipation member 930.

According to an embodiment, the first heat dissipation member 920 may be disposed between the antenna housing 910 and the antenna module 800 so as to dissipate heat generated from the antenna module 800. For example, the first heat dissipation member 920 may have a sheet shape having a size corresponding to the seating face 912. The sheet-shaped first heat dissipation member 920 may be made of a material having high thermal conductivity, such as copper (Cu), aluminum (Al), or gold (Au), or may include a heat transfer PC material or a graphite material. As another example, the first heat dissipation member 920 may include a heat transfer member such as a thermal interface material (TIM) tape or a heat pipe.

According to an embodiment, the first heat dissipation member 920 disposed on the seating face 912 may be disposed to face the RF communication circuit 840. Accordingly, heat generated from the RF communication circuit 840 may be quickly conducted to the first heat dissipation member 920 so that an efficient heat dissipation effect can be provided. As another example, the first heat dissipation member 920 is capable of blocking heat generated from the board 810 or blocking heat generated from the RF communication circuit 840 so as to prevent the heat from being transferred to a display (e.g., the display 330 in FIG. 4).

According to an embodiment, the second heat dissipation member 930 may be disposed between the antenna housing 910 and the electronic device 101 so as to dissipate heat generated from the antenna module 800. For example, the second heat dissipation member 930 may have a sheet shape having a size corresponding to the fixing face 911. The sheet-shaped second heat dissipation member 930 may be made of a material having high thermal conductivity, such as copper (Cu), aluminum (Al), or gold (Au), or may include a heat transfer PC material or a graphite material. As another example, the first heat dissipation member 920 may include a heat transfer member such as a TIM tape or a heat pipe.

According to an embodiment, the second heat dissipation member 930 disposed on the fixing face 911 may be disposed adjacent to the RF communication circuit 840, and may efficiently dissipate heat by quickly conducting the heat that has not been eliminated by the first heat dissipation member 920. As another example, the second heat dissipation member 930 may be disposed adjacent to the display 330 so as to face the display 330 so as to block heat generated from the board 810 or block heat generated from the RF communication circuit 840 so as to prevent the heat from being transferred to the display 330.

Figure 11:
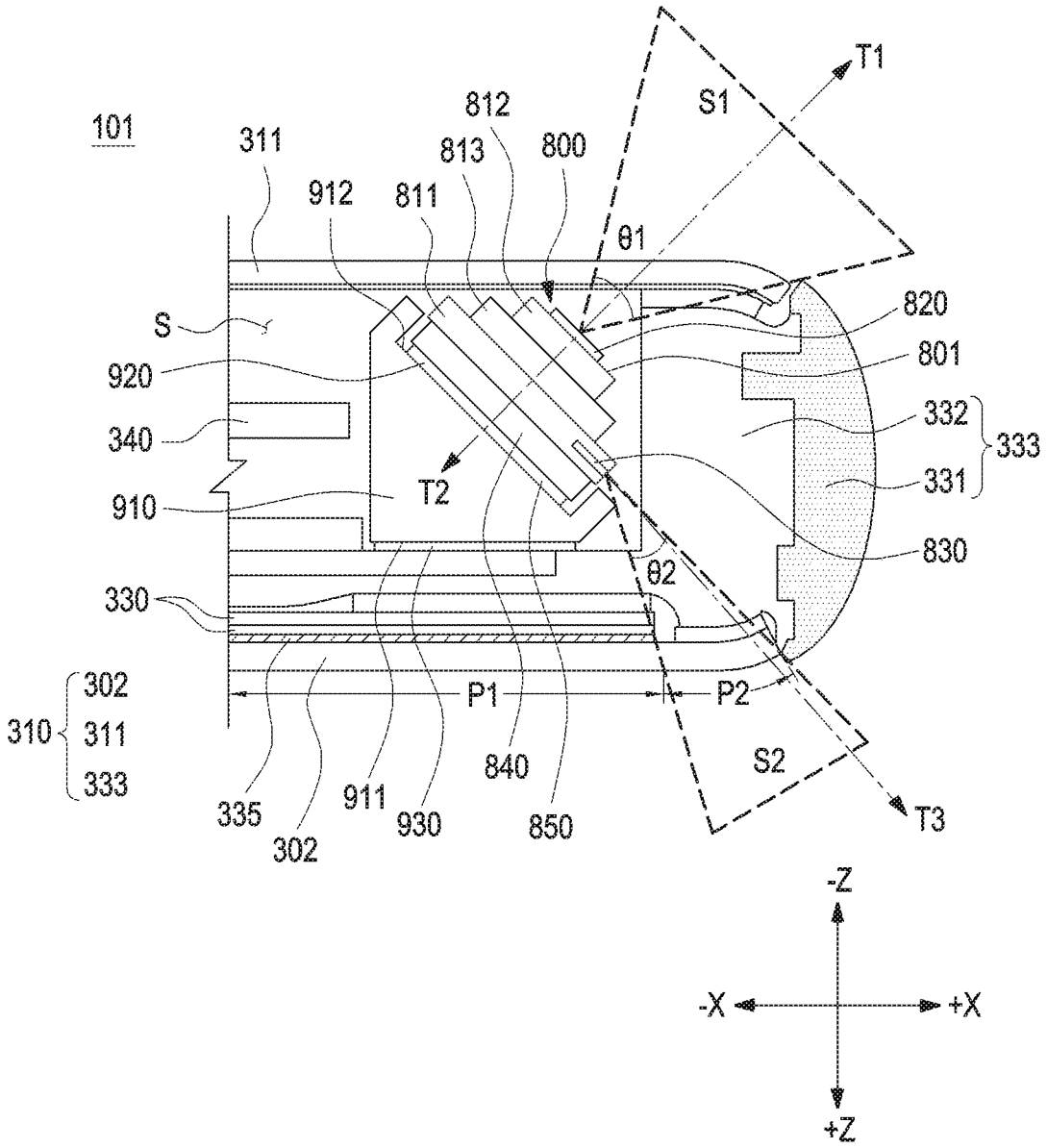
FIG. 11 is a cross-sectional view illustrating the inside of an electronic device in which the antenna module and the antenna housing according to various embodiments are disposed.
Figure 12:
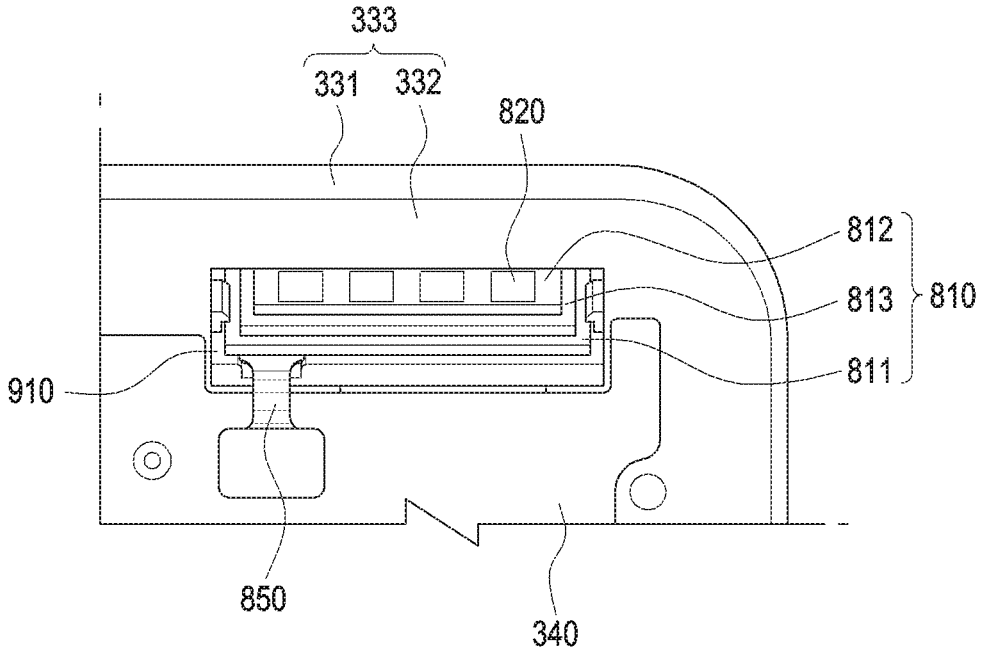
FIG. 12 is a plan view illustrating the inside of an electronic device, in which the antenna module and the antenna housing according to various embodiments are disposed.

FIG. 11 is a cross-sectional view illustrating the inside of an electronic device in which the antenna module 800 and the antenna housing 910 according to various embodiments are disposed. FIG. 12 is a plan view illustrating the inside of the electronic device in which the antenna module 800 and the antenna housing 910 according to various embodiments are disposed.

In FIG. 11, "X" in a 2-axis orthogonal coordinate system may indicate the longitudinal direction of the electronic device 101, and "Z" may indicate the thickness direction of the electronic device 101. In an embodiment, "Z" may indicate a first direction (+Z) or a second direction (−Z).

Referring to FIGS. 11 and 12, the electronic device 101 may include a housing 310, a display 330, an antenna module 800, and an antenna housing 910. The configurations of the housing 310 and the display 330 of FIGS. 11 and 12 may be partially or wholly the same as the configurations of the housing 310 and the display 330 in FIGS. 2 to 4. The configurations of the antenna module 800 and the antenna housing 910 of FIGS. 11 and 12 may be partially or wholly the same as the configurations of the antenna module 800 and the antenna housing 910 in FIGS. 8 to 9B.

According to various embodiments, the housing 310 may include a front plate 302 oriented in the first direction (+Z), a rear plate 311 oriented in the second direction (−Z) opposite the first direction (+Z), and a side member 333 surrounding the space S between the front plate 302 and the rear plate 311 and at least partially formed of a metal material.

According to an embodiment, the front plate 302 may include a transparent member, and the transparent member may include an active area P1 (e.g., a first portion) that provides an image and/or video to the user through the display 330 and an inactive area P2 extending from the active area P1 to the edge of the transparent member. At least a portion of the display 330 may be disposed under the active area P1 of the transparent member 310 in a flat state, and at least a portion of the display 330 may be disposed under the inactive area P2 in a flat or bent state. The lower portion of the inactive area P2 may be coated with an opaque nonconductive material such that internal electronic components, signal lines, or circuit lines are not visible to the outside. At least a portion of the inactive area P2 may include a radiation area of the antenna module 800. As another example, at least a portion (e.g., an edge area) of the rear plate 311 may include a radiation area of the antenna module 800.

According to an embodiment, the side member 333 may include a side bezel structure 331 and a bracket 332 extending inwards from the side bezel structure 331. At least a portion of the side bezel structure 331 may be formed of a metal material, and the bracket 332 may provide a space S in which the antenna housing 910 on which the antenna module 800 is mounted is seated. The bracket 332 may be formed of a nonmetal material. At least a partial area of the bracket 332 formed of the nonmetal material may be a radiation area of the antenna module 800.

According to various embodiments, the display panel (e.g., an (active) organic light-emitting diode) 330 may be exposed through the first portion (e.g., the active area P1) of the front plate 302, and may include a display element layer including one or more pixels and a TFT layer connected to the display element layer. According to an embodiment, an optical member and/or a touch sensor panel may be mounted between the front plate 302 and the display element layer or inside the display element layer. For example, the display device 330 may be an output device configured to output a screen, and may be used as an input device provided with a touch screen function. When the display panel 330 has a touch screen function, the display panel may correspond to an indium-tin oxide (ITO) film or a touch sensor panel for sensing the user's touch position or the like. As another example, a dielectric layer (not illustrated) may be disposed between the display element layer and the touch sensor panel, and a board may be disposed on the rear face of the display element layer. According to an embodiment, a dielectric layer 335 may be provided between the front plate 302 and the display 330. The dielectric layer 335 may be disposed to be in contact with the front plate 302, and may include, for example, silicon, air, foam, a membrane, an optically clear adhesive (OCA), sponge, rubber, ink, or a polymer (PC or PET).

According to various embodiments, the antenna module 800 and the antenna housing 910 may be disposed in the internal space S of the bracket 332. The antenna module 800 may include a first face 801 oriented in a third direction T1, which forms an acute angle with the second direction (−Z), and a second face 802 (e.g., the second face 802 in FIG. 7B) oriented in a fourth direction T2, which is opposite the third direction T1. For example, the antenna module 800 may include a structure in which the RF communication circuit 840 and the bridge circuit board 850 are sequentially stacked with reference to the multiple conductive layers constituting the board 810. When layers are stacked in the board 810 from a first layer 811, which is the lowermost layer, to a second layer 812, which is the uppermost layer, the outer face of the second layer may be the first face 801, and one face of the bridge circuit board 850 may be the second face 802.

According to an embodiment, the areas of the conductive layers constituting the board 810 may be different from each other. For example, the first layer 811 may have a first area, and the second layer 812 may have a second area smaller than the first area, and may be disposed on the first layer 811. The central portion of the second layer 812 may be disposed closer to the rear plate 311 than the central portion of the first layer 811. As another example, a third layer 813 may be larger than the second area and smaller than the first area, and may be stacked between the first layer 812 and the second layer 812. The central portion of the third layer 813 may be disposed closer to the rear plate 311 than the central portion of the first layer 811.

According to various embodiments, the antenna module 800 may include the antenna radiator, and the antenna radiator may include at least one first conductive element 820 and at least one second conductive element 830. For example, the at least one first conductive element 820 may be a patch antenna, and the at least one second conductive element 830 may be a dipole antenna.

According to an embodiment, the first conductive element 820 may be disposed on the first face 801 of the antenna module 800 so as to be oriented in the third direction T1, or may be disposed in the antenna module 800 so as to be oriented in the third direction T1. The first conductive element 820 may transmit or receive a high-frequency signal through a portion of the rear plate 311. The first radiation area S1, through which the first conductive element 820 transmits or receives a high-frequency signal, may be an area extending upwards and downwards or leftwards and rightwards to a designated extent with respect to the third direction T1, and may form a first designated angle θ1 when viewed in cross section. The first radiation area S1 may include a portion of the rear plate 311 made of a nonmetal material and an edge area of the bracket 332, and the first designated angle θ1 may be variable. For example, the RF communication circuit 840 may include a phase shifter connected to the first conductive element 820, and may control the direction in which the first conductive element 820 is oriented.

According to an embodiment, the second conductive element 830 may be disposed between the first face 801 and the second face 802 of the antenna module 800 and adjacent to the side member 333 (e.g., a side face of the bracket 332). The second conductive element 830 may be disposed to extend in a fifth direction T3, which is different from the third direction T1 and the fourth direction T2 and is oriented toward the space between the active area P1 (e.g., the first portion) of the front plate 302 and the side member (e.g., the side surface of the bracket 332). For example, the fifth direction T3 may be a direction oriented from the end of the first layer 811 toward the inactive area P2 of the front plate 302. As another example, the fifth direction T3 may be substantially perpendicular to the third direction T1.

According to an embodiment, the second conductive element 830 may transmit or receive a high-frequency signal through a portion of the front plate 302. The second radiation area S2, through which the first conductive element 820 transmits or receives a high-frequency signal, may be an area extending upwards and downwards or leftwards and rightwards to a designated extent with respect to the fifth direction T3, and may form a second designated angle θ2 when viewed in cross section. The second radiation area S2 may include a portion of the front plate 302 made of a nonmetal material and an edge area of the bracket 332, and the second designated angle θ2 may be variable. For example, the RF communication circuit 840 may include a phase shifter connected to the second conductive element 830, and may control the direction in which the second conductive element 830 is oriented.

According to various embodiments, the antenna module 800 may include a bridge circuit board 850 connected to the RF communication circuit 840. The bridge circuit board 850 may include a connector (e.g., the connector 851 in FIG. 9B), and the connector 851 may be electrically connected to the main circuit board (e.g., the printed circuit board 340 in FIG. 4) of the electronic device 101.

According to various embodiments, the antenna housing 910 may be fixed to one face of the bracket 332 of the electronic device 101 in the state in which the antenna module 800 is mounted thereon. The antenna housing 910 may include at least one fixing member (e.g., a hook or a screw) in order to fix the antenna housing 910 inside the electronic device 101.

According to an embodiment, the antenna housing 910 may be formed as an integral injection-molded product, and may include a fixing face 911 facing the electronic device 101 and a seating face 912 on which the antenna module 800 is seated. The fixing face 911 is a face that is in contact with an inner portion of the electronic device 101, and may be provided as a face oriented in the second direction −Z. The seating face 912 may be provided in a groove shape, which is recessed inwards, and may have a designated slope. The designated slope may be formed to correspond to the stacked direction of the board 810 and the direction in which the first conductive element 820 disposed on one face of the board 810 is oriented. For example, the seating face 912 may be disposed to be oriented in the third direction T1.

According to various embodiments, a heat dissipation member 920 or 730 may be disposed on one face of the antenna housing 910 so as to guide the diffusion of heat emitted from the antenna module 800. The heat dissipation member 920 or 930 may include a first heat dissipation member 920 disposed between the antenna housing 910 and the antenna module 800 and a second heat dissipation member 930 disposed between the antenna housing 910 and the bracket 332.

Figure 13:
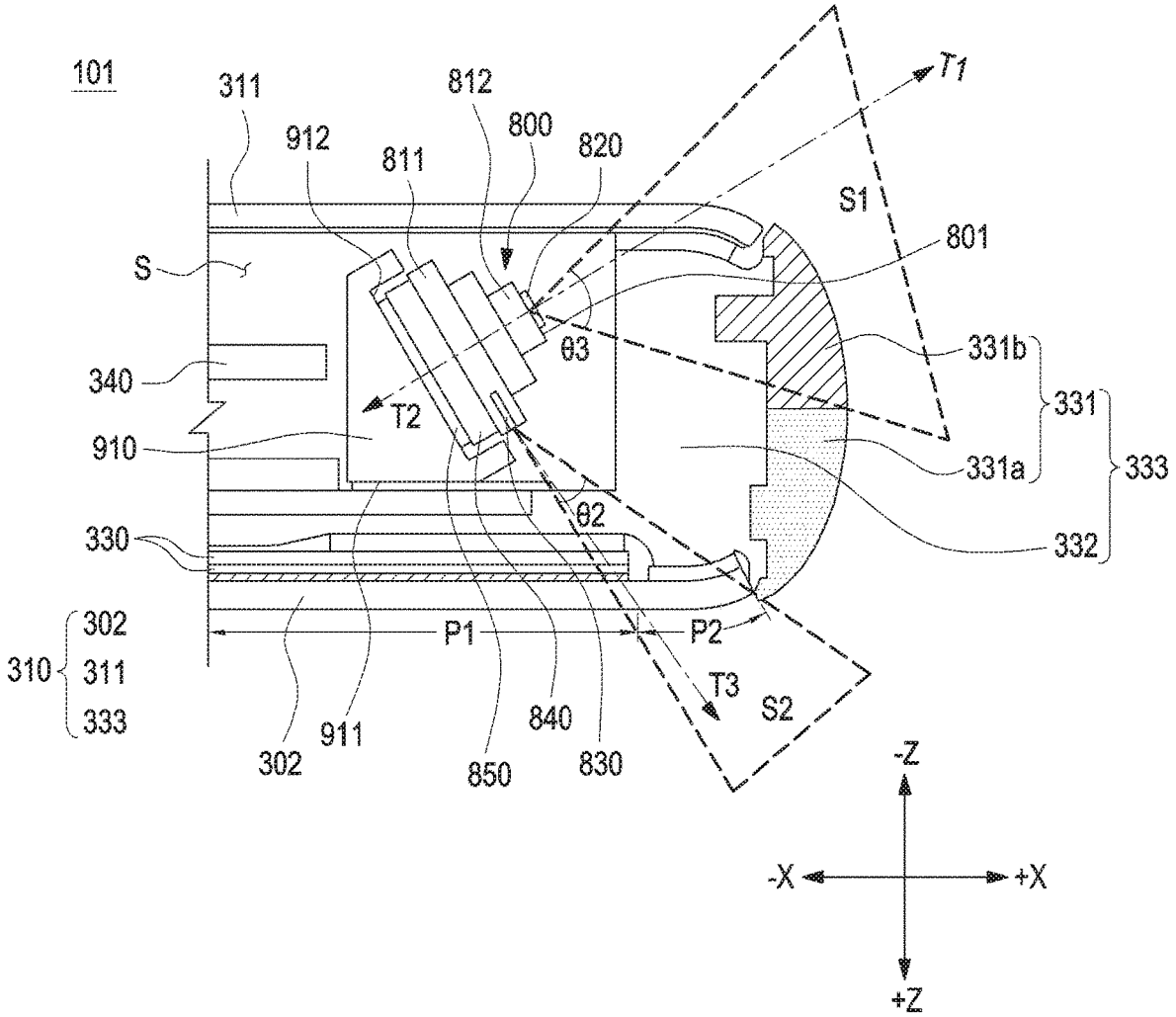
FIG. 13 is a cross-sectional view illustrating the inside of an electronic device in which an antenna module and an antenna housing according to another embodiment are disposed.

FIG. 13 is a cross-sectional view illustrating the inside of an electronic device in which an antenna module 800 and an antenna housing 910 according to another embodiment are disposed.

In FIG. 13, "X" in a 2-axis orthogonal coordinate system may indicate the longitudinal direction of the electronic device 101, and "Z" may indicate the thickness direction of the electronic device 101. In addition, in an embodiment, "Z" may indicate a first direction (+Z) or a second direction (−Z), and "X" may indicate a third direction (+X or −X).

Referring to FIG. 13, the electronic device 101 may include a housing 310, a display 330, an antenna module 800, and an antenna housing 910. The descriptions of the configurations of the housing 310, the display 330, the antenna module 800, and the antenna housing 910 of FIGS. 11 and 12 may be applicable to the configurations of the housing 310, the display 330, the antenna module 800, and the antenna housing 910 of FIG. 13. Hereinafter, the side member 333, the antenna module 800, and the antenna housing 910 of FIG. 13 will be described focusing on the differences between the configurations of the side member 333, the antenna module 800, and the antenna housing 910 of FIG. 13 and the configurations of the side member 333 of the housing 310, the antenna module 800, and the antenna housing 910 of FIGS. 11 and 12. For example, in the embodiment of FIG. 13, the antenna radiation area of the antenna module 800 may vary depending on the material and configuration of the side member 333.

According to various embodiments, the housing 310 may include a front plate 302, a rear plate 311, and a side member 333, and the side member 333 may include a side bezel structure 331 and a bracket 332 extending inwards from the side bezel structure 331. At least a portion of the side bezel structure 331 may be formed of a metal material. According to an embodiment, the side bezel structure 331 may be divided into a first side portion 331*a* formed of a metal material and a second side portion 331*b* formed of a nonmetal material. For example, the first side portion 331*a* may extend from the central portion of the side bezel structure 331 to an area facing the front side (e.g., the first direction (+Z)), and the second side portion 331*b* may extend from the central portion of the side bezel structure 331 to an area facing the rear side (e.g., the second direction (−Z)). The bracket 332 may provide a space S in which the antenna housing 910 on which the antenna module 800 is mounted is seated. The bracket 332 may be formed of a nonmetal material. At least a partial area of the bracket 332 formed of the nonmetal material and the second side portion 331*b* of the side bezel structure 331 may be utilized as a radiation area of the antenna module 800.

According to various embodiments, the antenna module 800 and the antenna housing 910 may be disposed in the internal space S of the bracket 332. The antenna module 800 may include a first face 801 oriented in a third direction T1, which forms an acute angle with the second direction (−Z) and a second face (e.g., the second face 802 in FIG. 9B) oriented in a fourth direction T2, which is opposite the third direction T1. For example, the antenna module 800 may include a structure in which the RF communication circuit 840 and the bridge circuit board (e.g., the bridge circuit board 850 in FIG. 9B) are sequentially stacked with reference to the multiple conductive layers constituting the board 810. When layers are stacked in the board 810 from a first layer 811, which is the lowermost layer, to a second layer 812, the outer face of the second layer may be the first face 801, and one face of the bridge circuit board 850 may be the second face 802.

According to various embodiments, the antenna module 800 may include the antenna radiator, and the antenna radiator may include at least one first conductive element 820 and at least one second conductive element 830. For example, the at least one first conductive element 820 may be a patch antenna, and the at least one second conductive element 830 may be a dipole antenna.

According to an embodiment, the first conductive element 820 may be disposed on the first face 801 of the antenna module 800 so as to be oriented in the third direction T1, or may be disposed in the antenna module 800 so as to be oriented in the third direction T1. The first conductive element 820 may transmit or receive a high-frequency signal through a portion of the rear plate 311. The first radiation area S1, through which the first conductive element 820 transmits or receives a high-frequency signal, may be an area extending upwards and downwards or leftwards and rightwards to a designated extent with respect to the third direction T1, and may form a third designated angle θ3 when viewed in cross section. The first radiation area S1 may include a portion of the rear plate 311 made of a nonmetal material and edge areas of the bracket 332 and the side bezel structure 331. For example, a portion of the first radiation area S1 may be an area facing the rear plate 311 from the first conductive element 820, and another portion of the first radiation area S may be an area facing the second side portion 331*b* of the side bezel structure 331 from the first conductive element 820 via the edge area of the bracket 332. According to an embodiment, the third designated angle θ3 may be variable. For example, the RF communication circuit 840 may include a phase shifter connected to the first conductive element 820, and may control the direction in which the first conductive element 820 is oriented. As another example, the acute angle formed by the second direction (−Z) and the third direction T1 in FIGS. 10A and 10B may be greater than the acute angle formed by the second direction (−Z) and the third direction T1 in FIGS. 9A and 9B.

According to an embodiment, the second conductive element 830 may be disposed between the first face 801 and the second face 802 of the antenna module 800 and adjacent to the side member 333 (e.g., a side face of the bracket 332). The second conductive element 830 may be disposed to extend in a fifth direction T3, which is different from the third direction T1 and the fourth direction T2 and is oriented toward the space between the active area P1 (e.g., the first portion) of the front plate 302 and the side member (e.g., the side surface of the bracket 332). For example, the fifth direction T3 may be a direction oriented from the end of the first layer 811 toward the inactive area P2 of the front plate 302. As another example, the fifth direction T3 may be substantially perpendicular to the third direction T1.

According to an embodiment, the second conductive element 830 may transmit or receive a high-frequency signal through a portion of the front plate 302. The second radiation area S2, through which the first conductive element 820 transmits or receives a high-frequency signal, may be an area extending upwards and downwards or leftwards and rightwards to a designated extent with respect to the fifth direction T3, and may form a second designated angle θ2 when viewed in cross section. The second radiation area S2 may include a portion of the front plate 302 made of a nonmetal material and an edge area of the bracket 332, and the second designated angle θ2 may be variable.

According to various embodiments, the antenna housing 910 may be fixed to one face of the bracket 332 of the electronic device 101 in the state in which the antenna module 800 is mounted thereon. The antenna housing 910 may include at least one fixing member (e.g., a hook or a screw) in order to fix the antenna housing 910 inside the electronic device 101. According to an embodiment, the antenna housing 910 may be formed as an integral injection-molded product, and may include a fixing face 911 facing the electronic device 101 and a seating face 912 on which the antenna module 800 is seated. The fixing face 911 is a face, which is in contact with an inner portion of the electronic device 101, and may be provided as a face oriented in the second direction (−Z). The seating face 912 may be provided in a groove shape, which is recessed inwards, and may have a designated slope. The designated slope may be formed to correspond to the stacked direction of the board 810 and the direction in which the first conductive element 820 disposed on one face of the board 810 is oriented. For example, the seating face 912 may be disposed to be oriented in the third direction T1.

Figure 14:
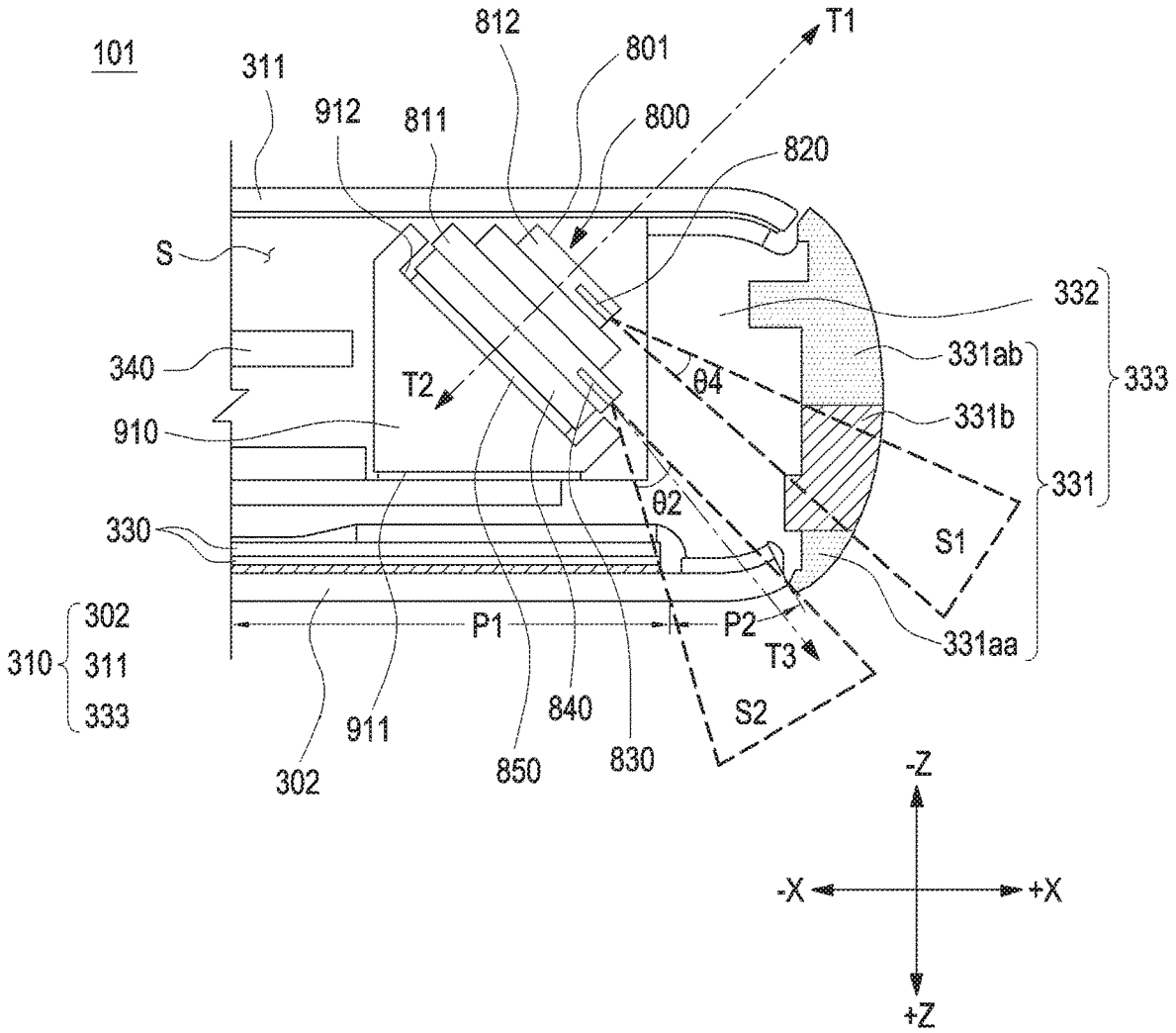
FIG. 14 is a cross-sectional view illustrating the inside of an electronic device in which an antenna module and an antenna housing according to still another embodiment are disposed.

FIG. 14 is a cross-sectional view illustrating the inside of an electronic device in which an antenna module 800 and an antenna housing 910 according to still another embodiment are disposed.

In FIG. 14, "X" in a 2-axis orthogonal coordinate system may indicate the longitudinal direction of the electronic device 101, and "Z" may indicate the thickness direction of the electronic device 101. In an embodiment, "Z" may indicate a first direction (+Z) or a second direction (−Z).

Referring to FIG. 14, the electronic device 101 may include a housing 310, a display 330, an antenna module 800, and an antenna housing 910. The descriptions of the configurations of the housing 310, the display 330, the antenna module 800, and the antenna housing 910 of FIGS. 11 and 12 may be applicable to the configurations of the housing 310, the display 330, the antenna module 800, and the antenna housing 910 of FIG. 14. Hereinafter, the side member 333, the antenna module 800, and the antenna housing 910 of FIG. 14 will be described focusing on the differences between the configurations of the side member 333, the antenna module 800, and the antenna housing 910 of FIG. 13 and the configurations of the side member 333 of the housing 310, the antenna module 800, and the antenna housing 910 of FIGS. 11 and 12. For example, in the embodiment of FIG. 14, the antenna radiation area of the antenna module 800 may vary depending on the material and configuration of the side member 333.

According to various embodiments, the housing 310 may include a front plate 302, a rear plate 311, and a side member 333, and the side member 333 may include a side bezel structure 331 and a bracket 332 extending inwards from the side bezel structure 331. At least a portion of the side bezel structure 331 may be formed of a metal material. According to an embodiment, the side bezel structure 331 may be divided into first side portions 331*aa* and 331*ab* formed of a metal material and a second side portion 331*b* formed of a nonmetal material. For example, the second side portion 331*b* may be formed in the central portion of the side bezel structure 331, and the first side portions 331*aa* and 331*ab* may extend to opposite sides of the second side portion 331*b*. For example, the (1-1)th side portion 331*aa* may extend from one end of the second side portion 331*b* to an area facing the front side (e.g., the first direction (+Z)), and the (1-2)th side portion 331*ab* may extend from the other end of the second side portion 331*b* to an area facing the rear side (e.g., the second direction (−Z)). The bracket 332 may provide a space in which the antenna housing 910 on which the antenna module 800 is mounted is seated. The bracket 332 may be formed of a nonmetal material. At least a partial area of the bracket 332 formed of the nonmetal material and the second side portion 331*b* of the side bezel structure 331 may be utilized as a radiation area of the antenna module 800.

According to various embodiments, the antenna module 800 and the antenna housing 910 may be disposed in the internal space S of the bracket 332. The antenna module 800 may include a first face 801 oriented in a third direction T1, which forms an acute angle with the second direction (−Z), and a second face 802 oriented in a fourth direction T2, which is opposite the third direction T1. For example, the antenna module 800 may include a structure in which the RF communication circuit 840 and the bridge circuit board 850 are sequentially stacked with reference to the multiple conductive layers constituting the board 810. When layers are stacked in the board 810 from a first layer 811, which is the lowermost layer, to a second layer 812, which is the uppermost layer, the outer face of the second layer may be the first face 801, and one face of the bridge circuit board 850 may be the second face 802.

According to various embodiments, the antenna module 800 may include the antenna radiator, and the antenna radiator may include at least one first conductive element 820 and at least one second conductive element 830. For example, the at least one first conductive element 820 may be a dipole antenna, and the at least one second conductive element 830 may be a dipole antenna.

According to an embodiment, the first conductive element 820 may be disposed on the first face (e.g., the second layer 812) of the antenna module 800 to be oriented in a fifth direction T3, which is different from the third direction T1 and the fourth direction T2 and is oriented toward the second side portion 331*b* of the side member 333. For example, the fifth direction T3 may be substantially perpendicular to the third direction T1. The first conductive element 820 may transmit or receive a high-frequency signal through a portion of the side member 333. The first radiation area S1, through which the first conductive element 820 transmits or receives a high-frequency signal, may be an area extending upwards and downwards or leftwards and rightwards to a designated extent with respect to the fifth direction T3, and may form a fourth designated angle θ4 when viewed in cross section. The first radiation area S1 may include an edge area of the side bezel structure 331 made of a nonmetal material. For example, the first radiation area S may be an area facing the second side portion 331*b* of the side bezel structure 331 from the first conductive element 820 via the edge area of the bracket 332. According to an embodiment, the fourth designated angle θ4 may be variable. For example, the RF communication circuit 840 may include a phase shifter connected to the first conductive element 820, and may control the direction in which the first conductive element 820 is oriented.

According to an embodiment, the second conductive element 830 may be disposed between the first face 801 and the second face 802 of the antenna module 800 and adjacent to the side member 333 (e.g., a side face of the bracket 332). The second conductive element 830 may be disposed to extend in a fifth direction T3, which is different from the third direction T1 and the fourth direction T2 and is oriented toward the space between the active area P1 (e.g., the first portion) of the front plate 302 and the side member (e.g., the side surface of the bracket 332). The arrangement of the second conductive element 830 may be substantially parallel to the arrangement of the first conductive element 820. For example, the fifth direction T3 may be a direction oriented from the end of the first layer 811 toward the inactive area P2 of the front plate 302. As another example, the fifth direction T3 may be substantially perpendicular to the third direction T1.

According to an embodiment, the second conductive element 830 may transmit or receive a high-frequency signal through a portion of the front plate 302. The second radiation area S2, through which the first conductive element 820 transmits or receives a high-frequency signal, may be an area extending upwards and downwards or leftwards and rightwards to a designated extent with respect to the fifth direction T3, and may form a second designated angle θ2 when viewed in cross section. The second radiation area S2 may include a portion of the front plate 302 made of a nonmetal material and an edge area of the bracket 332, and the second designated angle θ2 may be variable.

Figure 15:
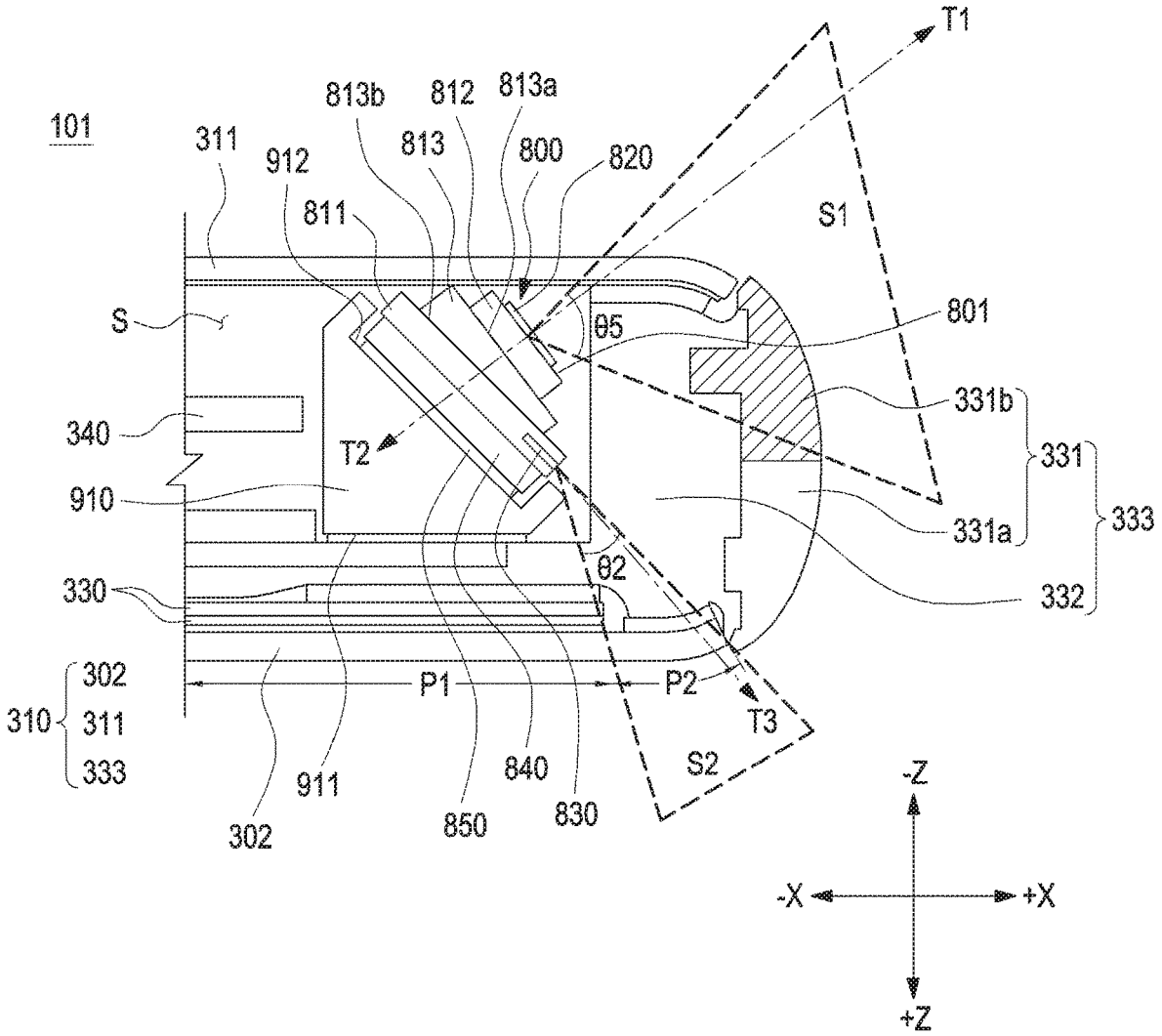
FIG. 15 is a cross-sectional view illustrating the inside of an electronic device in which an antenna module and an antenna housing according to still another embodiment are disposed.

FIG. 15 is a cross-sectional view illustrating the inside of an electronic device in which an antenna module 800 and an antenna housing 910 according to still another embodiment are disposed.

In FIG. 15, "X" in a 2-axis orthogonal coordinate system may indicate the longitudinal direction of the electronic device 101, and "Z" may indicate the thickness direction of the electronic device 101. In an embodiment, "Z" may indicate a first direction (+Z) or a second direction (−Z).

Referring to FIG. 15, the electronic device 101 may include a housing 310, a display 330, an antenna module 800, and an antenna housing 910. The descriptions of the configurations of the housing 310, the display 330, the antenna module 800, and the antenna housing 910 of FIGS. 11 and 12 may be applicable to the configurations of the housing 310, the display 330, the antenna module 800, and the antenna housing 910 of FIG. 15. Hereinafter, the side member 333, the antenna module 800, and the antenna housing 910 of FIG. 15 will be described focusing on the differences between the configurations of the side member 333, the antenna module 800, and the antenna housing 910 of FIG. 13 and the configurations of the side member 333 of the housing 310, the antenna module 800, and the antenna housing 910 of FIGS. 11 and 12. For example, in the embodiment of FIG. 15, the antenna radiation area of the antenna module 800 may vary depending on the material and configuration of the side member 333 and the structure of the antenna module 800.

According to various embodiments, the housing 310 may include a front plate 302, a rear plate 311, and a side member 333, and the side member 333 may include a side bezel structure 331 and a bracket 332 extending inwards from the side bezel structure 331. At least a portion of the side bezel structure 331 may be formed of a metal material. According to an embodiment, the side bezel structure 331 may be divided into a first side portion 331*a* formed of a metal material and a second side portion 331*b* formed of a nonmetal material. For example, the first side portion 331*a* may extend from the central portion of the side bezel structure 331 to an area facing the front side (e.g., the first direction (+Z)), and the second side portion 331*b* may extend from the central portion of the side bezel structure 331 to an area facing the rear side (e.g., the second direction (−Z)). The bracket 332 may provide a space in which the antenna housing 910 on which the antenna module 800 is mounted is seated. The bracket 332 may be formed of a nonmetal material. At least a partial area of the bracket 332 formed of the nonmetal material and the second side portion 331*b* of the side bezel structure 331 may be utilized as a radiation area of the antenna module 800.

According to various embodiments, the antenna module 800 and the antenna housing 910 may be disposed in the internal space of the bracket 332. The antenna module 800 may include a first face 801 oriented in a third direction T1, which forms an acute angle with the second direction (−Z), and a second face (e.g., the second face 802 in FIG. 7B) oriented in a fourth direction T2, which forms an acute angle with the first direction (+Z). For example, the antenna module 800 may include a structure in which the RF communication circuit 840 and the bridge circuit board 850 are sequentially stacked with reference to the multiple conductive layers constituting the board 810. When layers are stacked in the board 810 from a first layer 811, which is the lowermost layer, to a third layer 813 and a second layer 812, the outer face of the second layer 812 may be the first face 801, and one face of the bridge circuit board 850 may be the second face 802.

According to various embodiments, the third layer 813 may be disposed between the first layer 811 and the second layer 812, and may include a designated inclined face. For example, the third layer 813 includes a first face 813*a* facing the front side and a second face 813*b* facing the rear side, and the first face 813*a* and the second face 813*b* may not be parallel to each other or may not face each other. The first face 813*a* may be disposed in contact with the second layer 812, and the second face 813*b* may be in contact with the first layer 811, so that the first layer 811 and the second layer 812 may face different sides. Accordingly, the first conductive element 820 disposed on the first layer 811 may be disposed to be oriented in a different direction compared to the first conductive element 820 of FIGS. 9A and 9B. Thus, radio wave radiation areas thereof may be different from each other.

According to various embodiments, the antenna module 800 may include the antenna radiator, and the antenna radiator may include at least one first conductive element 820 and at least one second conductive element 830. For example, the at least one first conductive element 820 may be a patch antenna, and the at least one second conductive element 830 may be a dipole antenna.

According to an embodiment, the first conductive element 820 may be disposed on the first face 801 of the antenna module 800 to be oriented in the third direction T1, or may be disposed in the antenna module 800 to be oriented in the third direction T1. The first conductive element 820 may transmit or receive a high-frequency signal through a portion of the rear plate 311. The first radiation area S1, through which the first conductive element 820 transmits or receives a high-frequency signal, may be an area extending upwards and downwards or leftwards and rightwards to a designated extent with respect to the third direction T1, and may form a fifth designated angle θ5 when viewed in cross section. The first radiation area S1 may include a portion of the rear plate 311 made of a nonmetal material and edge areas of the bracket 332 and the side bezel structure 331. For example, a portion of the first radiation area S1 may be an area facing the rear plate 311 from the first conductive element 820, and another portion of the first radiation area S1 may be an area facing the second side portion 331*b* of the side bezel structure 331 from the first conductive element 820 via the edge area of the bracket 332. According to an embodiment, the fifth designated angle θ5 may be variable. For example, the RF communication circuit 840 may include a phase shifter connected to the first conductive element 820, and may control the direction in which the first conductive element 820 is oriented. As another example, the acute angle formed by the second direction (−Z) and the third direction T1 in FIG. 13 may be greater than the acute angle formed by the second direction (−Z) and the third direction T1 in FIGS. 9A and 9B.

According to an embodiment, the second conductive element 830 may be disposed between the first face 801 and the second face 802 of the antenna module 800 and adjacent to the side member (e.g., a side face of the bracket 332). The second conductive element 830 may be disposed to extend in a fifth direction T3, which is different from the third direction T1 and the fourth direction T2 and is oriented toward the space between the active area P1 (e.g., the first portion) of the front plate 302 and the side member (e.g., the side surface of the bracket 332). For example, the fifth direction T3 may be a direction oriented from the end of the first layer 811 toward the inactive area P2 of the front plate 302. As another example, the fifth direction T3 may be substantially perpendicular to the third direction T1.

According to an embodiment, the second conductive element 830 may transmit or receive a high-frequency signal through a portion of the front plate 302. The second radiation area S2, through which the first conductive element 820 transmits or receives a high-frequency signal, may be an area extending upwards and downwards or leftwards and rightwards to a designated extent with respect to the fifth direction T3, and may form a second designated angle θ2 when viewed in cross section. The second radiation area S2 may include a portion of the front plate 302 made of a nonmetal material and an edge area of the bracket 332, and the second designated angle θ2 may be variable.

Figure 16:
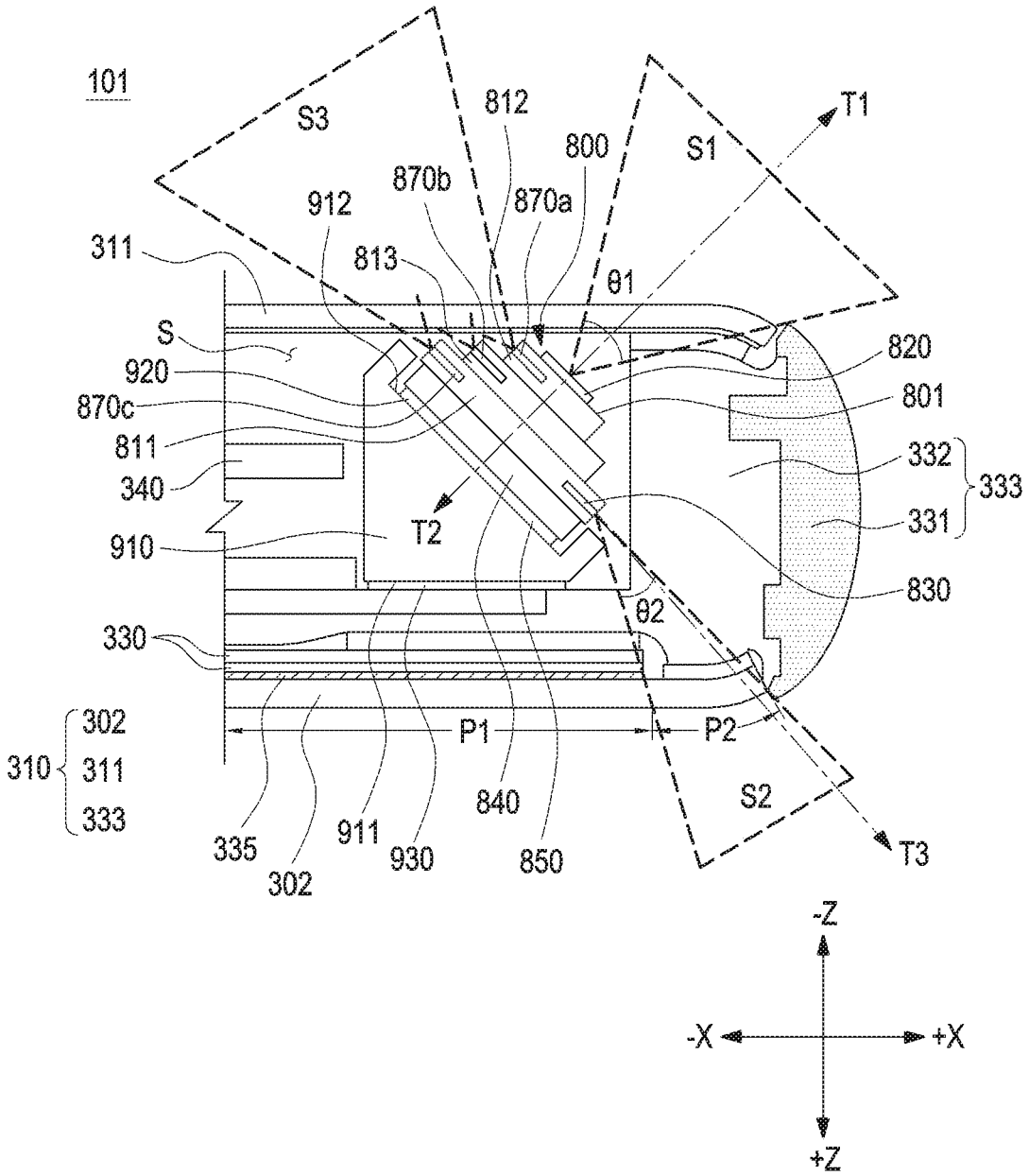
FIG. 16 is a cross-sectional view illustrating the inside of an electronic device in which an antenna module and an antenna housing according to still another embodiment are disposed.

FIG. 16 is a cross-sectional view illustrating the inside of an electronic device in which an antenna module 800 and an antenna housing 910 according to still another embodiment are disposed.

In FIG. 16, "X" in a 2-axis orthogonal coordinate system may indicate the longitudinal direction of the electronic device 101, and "Z" may indicate the thickness direction of the electronic device 101. In addition, in an embodiment, "Z" may indicate a first direction (+Z) or a second direction (−Z), and "X" may indicate a third direction (+X or −X).

Referring to FIG. 16, the electronic device 101 may include a housing 310, a display 330, an antenna module 800, and an antenna housing 910. The descriptions of the configurations of the housing 310, the display 330, the antenna module 800, and the antenna housing 910 of FIGS. 11 and 12 may be applicable to the configurations of the housing 310, the display 330, the antenna module 800, and the antenna housing 910 of FIG. 16. Hereinafter, the conductive elements of the antenna module 800 of FIG. 16 will be described focusing on the differences in arrangement between the conductive elements of the antenna module 800 of FIGS. 11 and 12 and the conductive elements of the antenna module 800 of FIG. 16. For example, the embodiment of FIG. 16 may represent various radiation areas depending on the configuration of the conductive elements.

According to various embodiments, the antenna module 800 and the antenna housing 910 may be disposed in the internal space S of the bracket 332. The antenna module 800 may include a first face 801 oriented in a third direction T1, which forms an acute angle with the second direction (−Z), and a second face 802 (e.g., the second face 802 in FIG. 11B) oriented in a fourth direction T2, which is opposite the third direction T1. For example, the antenna module 800 may include a structure in which the RF communication circuit 840 and the bridge circuit board (e.g., the bridge circuit board 850 in FIG. 11B) are sequentially stacked with reference to the multiple conductive layers constituting the board 810. When layers are stacked in the board 810 from a first layer 811, which is the lowermost layer, to a second layer 812, the outer face of the second layer may be the first face 801, and one face of the bridge circuit board 850 may be the second face 802.

According to various embodiments, the antenna module 800 may include the antenna radiator, and the antenna radiator may include at least one first conductive element 820, at least one second conductive element 830, and at least one third conductive element 870*a*, 870*b*, and 870*c*. For example, the at least one first conductive element 820 may be a patch antenna, and the at least one second conductive element 830 and the third conductive elements 870*a*, 870*b*, and 870*c* may be dipole antennas.

According to an embodiment, the first conductive element 820 may be disposed on the first face 801 of the antenna module 800 to be oriented in the third direction T1. The first conductive element 820 may transmit or receive a high-frequency signal through a portion of the rear plate 311. The first radiation area S1, through which the first conductive element 820 transmits or receives a high-frequency signal, may be an area extending upwards and downwards or leftwards and rightwards to a designated extent with respect to the third direction T1.

According to an embodiment, the second conductive element 830 may be disposed between the first face 801 and the second face 802 of the antenna module 800 and adjacent to the side member 333 (e.g., a side face of the bracket 332). The second conductive element 830 may be disposed to extend in a fifth direction T3, which is different from the third direction T1 and the fourth direction T2 and is oriented toward the space between the active area P1 (e.g., the first portion) of the front plate 302 and the side member (e.g., the side face of the bracket 332). The second radiation area S2, through which the second conductive element 830 transmits or receives a high-frequency signal, may be an area extending upwards and downwards or leftwards and rightwards to a designated extent with respect to the fifth direction T3.

According to an embodiment, the third conductive elements 870*a*, 870*b*, and 870*c* may be disposed on the side faces of the first layer 811, which is the lowermost layer, the third layer 813, and the second layer 812, respectively. The third conductive elements 870*a*, 870*b*, and 870*c* may be disposed to extend in a direction opposite the fifth direction T3. The third radiation area S3, through which the third conductive elements 870*a*, 870*b*, and 870*c* transmit or receive a high-frequency signal, may be an area extending to a designated extent in a direction opposite the fifth direction T3. However, the structures of the third conductive elements 870*a*, 870*b*, and 870*c* are not limited thereto, and the third conductive elements 870*a*, 870*b*, and 870*c* may be disposed only on some of the layers. Alternatively, when the antenna module 800 includes three or more layers, the third conductive elements may be disposed on respective layers or on some layers.

Figure 17:
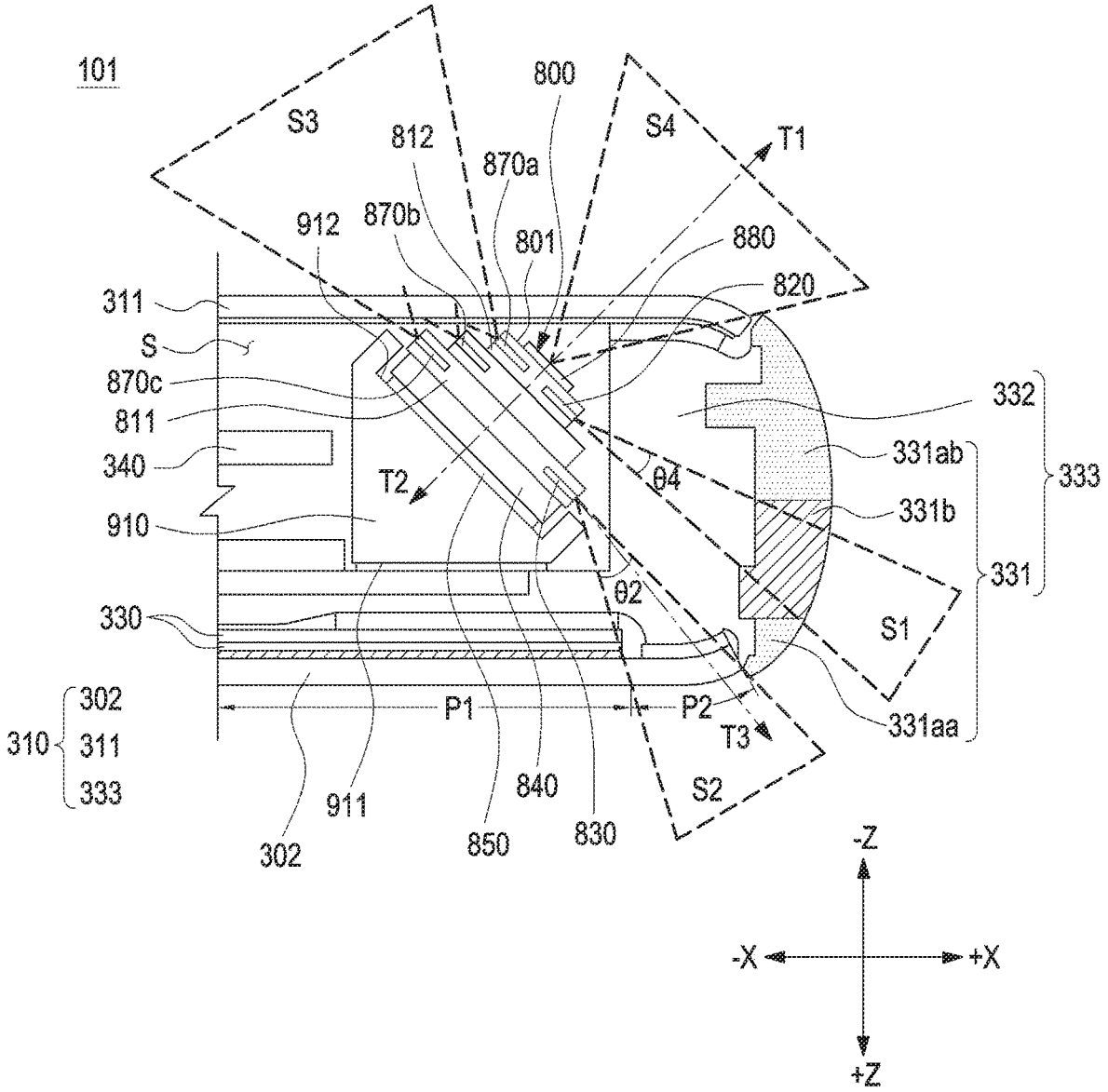
FIG. 17 is a cross-sectional view illustrating the inside of an electronic device in which an antenna module and an antenna housing according to still another embodiment are disposed.

FIG. 17 is a cross-sectional view illustrating the inside of an electronic device in which an antenna module 800 and an antenna housing 910 according to still another embodiment are disposed.

In FIG. 17, "X" in a 2-axis orthogonal coordinate system may indicate the longitudinal direction of the electronic device 101, and "Z" may indicate the thickness direction of the electronic device 101. In addition, in an embodiment, "Z" may indicate a first direction (+Z) or a second direction (−Z), and "X" may indicate a third direction (+X or −X).

Referring to FIG. 17, the electronic device 101 may include a housing 310, a display 330, an antenna module 800, and an antenna housing 910. The descriptions of the configurations of the housing 310, the display 330, the antenna module 800, and the antenna housing 910 of FIG. 14 may be applicable to the configurations of the housing 310, the display 330, the antenna module 800, and the antenna housing 910 of FIG. 16. Hereinafter, the conductive elements of the antenna module 800 of FIG. 17 will be described focusing on the differences in arrangement between the conductive elements of the antenna module 800 of FIG. 14 and the conductive elements of the antenna module 800 of FIG. 16. For example, the embodiment of FIG. 17 may represent various radiation areas, depending on the configurations of conductive elements.

According to various embodiments, the antenna module 800 and the antenna housing 910 may be disposed in the internal space S of the bracket 332. The antenna module 800 may include a first face 801 oriented in a third direction T1, which forms an acute angle with the second direction (−Z), and a second face 802 (e.g., the second face 802 in FIG. 11B) oriented in a fourth direction T2, which is opposite the third direction T1. For example, the antenna module 800 may include a structure in which the RF communication circuit 840 and the bridge circuit board (e.g., the bridge circuit board 850 in FIG. 11B) are sequentially stacked with reference to the multiple conductive layers constituting the board 810. When layers are stacked in the board 810 from a first layer 811, which is the lowermost layer, to a second layer 812, the outer face of the second layer may be the first face 801, and one face of the bridge circuit board 850 may be the second face 802.

According to various embodiments, the antenna module 800 may include the antenna radiator, and the antenna radiator may include at least one first conductive element 820, at least one second conductive element 830, at least one third conductive element 870*a*, 870*b*, and 870*c*, and at least one fourth conductive element 880. For example, the at least one first conductive element 820 may be a dipole antenna, and the at least one second conductive element 830 may be a dipole antenna. As another example, the third conductive elements 870*a*, 870*b*, and 870*c* may be dipole antennas, and the fourth conductive element 880 may be a patch antenna.

According to an embodiment, the first conductive element 820 may be disposed on the first face (e.g., the second layer 812) of the antenna module 800 to extend in a direction that is different from the third direction T1 and the fourth direction T2 and is oriented toward the second side portion 331*b* of the side member 333. The first conductive element 820 may transmit or receive a high-frequency signal through a portion of the side member 333.

According to an embodiment, the second conductive element 830 may be disposed between the first face 801 and the second face 802 of the antenna module 800 and adjacent to the side member 333 (e.g., a side face of the bracket 332). The direction in which the second conductive element 830 is oriented may be parallel to the direction in which the first conductive element 820 is oriented. According to an embodiment, the second conductive element 830 may transmit or receive a high-frequency signal through a portion of the front plate 302.

According to an embodiment, the third conductive elements 870*a*, 870*b*, and 870*c* may be disposed on the side faces of the first layer 811, which is the lowermost layer, the third layer 813, and the second layer 812, respectively. The third conductive elements 870*a*, 870*b*, and 870*c* may be disposed to extend in a direction opposite the direction in which the first conductive element 820 or the second conductive element 830 is oriented. The third radiation area S3, through which the third conductive elements 870*a*, 870*b*, and 870*c* transmit or receive a high-frequency signal, may be an area extending to a designated extent toward the rear plate. However, the structures of the third conductive elements 870*a*, 870*b*, and 870*c* are not limited thereto, and the third conductive elements 870*a*, 870*b*, and 870*c* may be disposed on only some of the layers. Alternatively, when the antenna module 800 includes three or more layers, the third conductive elements may be disposed on respective layers or on some layers.

According to an embodiment, the fourth conductive element 880 may be disposed on the first face 801 of the antenna module 800 to be oriented in the third direction T1. The first conductive element 820 may transmit or receive a high-frequency signal through a portion of the rear plate 311. The first radiation area S1, through which the first conductive element 820 transmits or receives a high-frequency signal, may be an area extending upwards and downwards or leftwards and rightwards to a designated extent with respect to the third direction T1.

Figure 18:
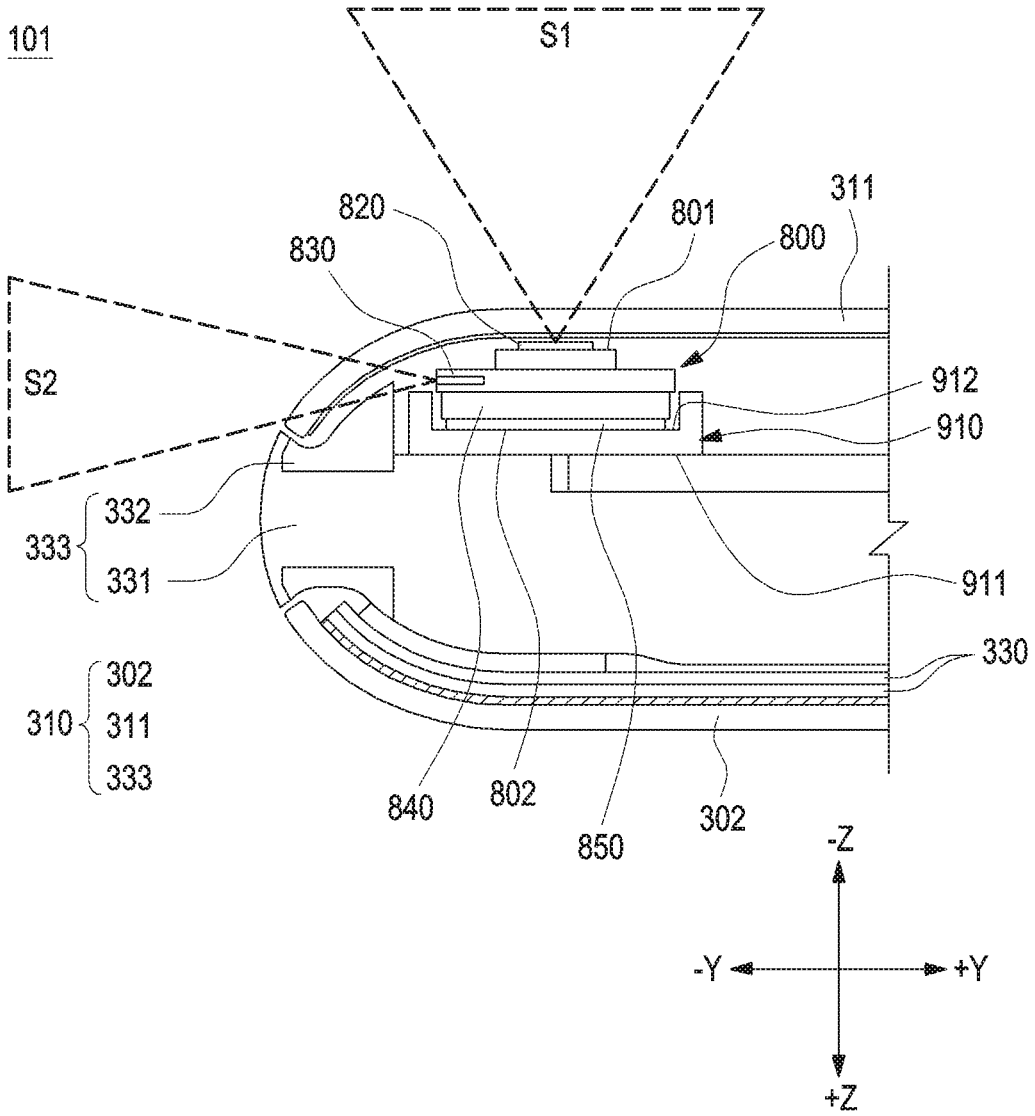
FIG. 18 is a cross-sectional view illustrating the inside of an electronic device in which an antenna module and an antenna housing according to another embodiment are disposed.

FIG. 18 is a cross-sectional view illustrating the inside of an electronic device in which an antenna module 800 and an antenna housing 910 according to another embodiment are disposed.

In FIG. 18, "Y" in a 2-axis orthogonal coordinate system may indicate the width direction of the electronic device 101, and "Z" may indicate the thickness direction of the electronic device 101. In an embodiment, "Z" may indicate a first direction (+Z) or a second direction (−Z).

Referring to FIG. 18, the electronic device 101 may include a housing 310, a display 330, an antenna module 800, and an antenna housing 910. The descriptions of the configurations of the housing 310, the display 330, the antenna module 800, and the antenna housing 910 of FIGS. 11 and 12 may be applicable to the configurations of the housing 310, the display 330, the antenna module 800, and the antenna housing 910 of FIG. 18. Hereinafter, the side member 333, the antenna module 800, and the antenna housing 910 of FIG. 18 will be described focusing on the differences between the configurations of the side member 333, the antenna module 800, and the antenna housing 910 of FIG. 13 and the configurations of the side member 333 of the housing 310, the antenna module 800, and the antenna housing 910 of FIGS. 11 and 12. For example, in the embodiment of FIG. 18, the antenna radiation area of the antenna module 800 may vary depending on the area in which the antenna housing 910 and the antenna module 800 are disposed and the structure of the antenna housing 910.

According to various embodiments, the housing 310 may include a front plate 302, a rear plate 311, and a side member 333, and the side member 333 may include a side bezel structure 331 and a bracket 332 extending inwards from the side bezel structure 331. At least a portion of the side bezel structure 331 may be formed of a metal material. As illustrated, since the width direction (+Y and −Y directions) of the housing is implemented in a curved shape along the edge, unlike the longitudinal direction, the area formed by the side bezel structure 331 of the metal material of the side member 333 may be relatively small. Accordingly, it may be advantageous to mount the antenna module 800 horizontally without inclination. According to various embodiments, the antenna module 800 and the antenna housing 910 may be disposed in the internal space of the bracket 332. The antenna module 800 may include a first face 801 oriented in the second (−Z) direction and a second face 802 oriented in the first (+Z) direction opposite the second (−Z) direction. For example, the antenna module 800 may include a structure in which the RF communication circuit 840 and the bridge circuit board 850 are sequentially stacked with reference to the multiple conductive layers constituting the board 810. When layers are stacked in the board 810 from a first layer 811, which is the lowermost layer, to a second layer 812, which is the uppermost layer, the outer face of the second layer 812 may be the first face 801, and one face of the bridge circuit board 850 may be the second face 802.

According to various embodiments, the antenna module 800 may include the antenna radiator, and the antenna radiator may include at least one first conductive element 820 and at least one second conductive element 830. For example, the at least one first conductive element 820 may be a patch antenna, and the at least one second conductive element 830 may be a dipole antenna.

According to an embodiment, the first conductive element 820 may be disposed on the first face 801 of the antenna module 800 to be oriented in the second direction (−Z), or may be disposed in the antenna module 800 to be oriented in the second direction (−Z). The first conductive element 820 may transmit or receive a high-frequency signal through a portion of the rear plate 311. The first radiation area S1, through which the first conductive element 820 transmits or receives a high-frequency signal, may be an area extending upwards and downwards or leftwards and rightwards to a designated extent with respect to the second direction (−Z).

According to an embodiment, the second conductive element 830 may be disposed between the first face 801 and the second face 802 of the antenna module 800 and adjacent to the side member (e.g., a side face of the bracket 332). The second conductive element 830 may be disposed to extend in a direction that is different from the first direction (+Z) and the second direction (−Z) and is parallel to the direction oriented toward a portion of the rear plate 333 and the side member 333 (e.g., the side face of the bracket 332). As another example, the direction in which the second conductive element 830 extends may be substantially perpendicular to the first direction (+Z) or the second direction (−Z). The second conductive element 830 may transmit or receive a high-frequency signal. The second radiation area S2, through which the second conductive element 830 transmits or receives a high-frequency signal, may be an area extending upwards and downwards or leftwards and rightwards to a designated extent with respect to a direction (e.g., +Y direction) perpendicular to the second direction (−Z).

According to various embodiments, the antenna housing 910 may be fixed to one face of the bracket 332 of the electronic device 101 in the state in which the antenna module 800 is mounted thereon. The antenna housing 910 may include at least one fixing member (e.g., a hook or a screw) in order to fix the antenna housing 910 inside the electronic device 101. According to an embodiment, the antenna housing 910 may be formed as an integral injection-molded product, and may include a fixing face 911 facing the electronic device 101 and a seating face 912 on which the antenna module 800 is seated. The fixing face 911 is a face that is in contact with an inner portion of the electronic device 101, and may be provided as a face oriented in the first direction (+Z). The seating face 912 is a face, which is provided in a groove shape, and may be provided as a face oriented in the second direction (−Z).

Figure 19:
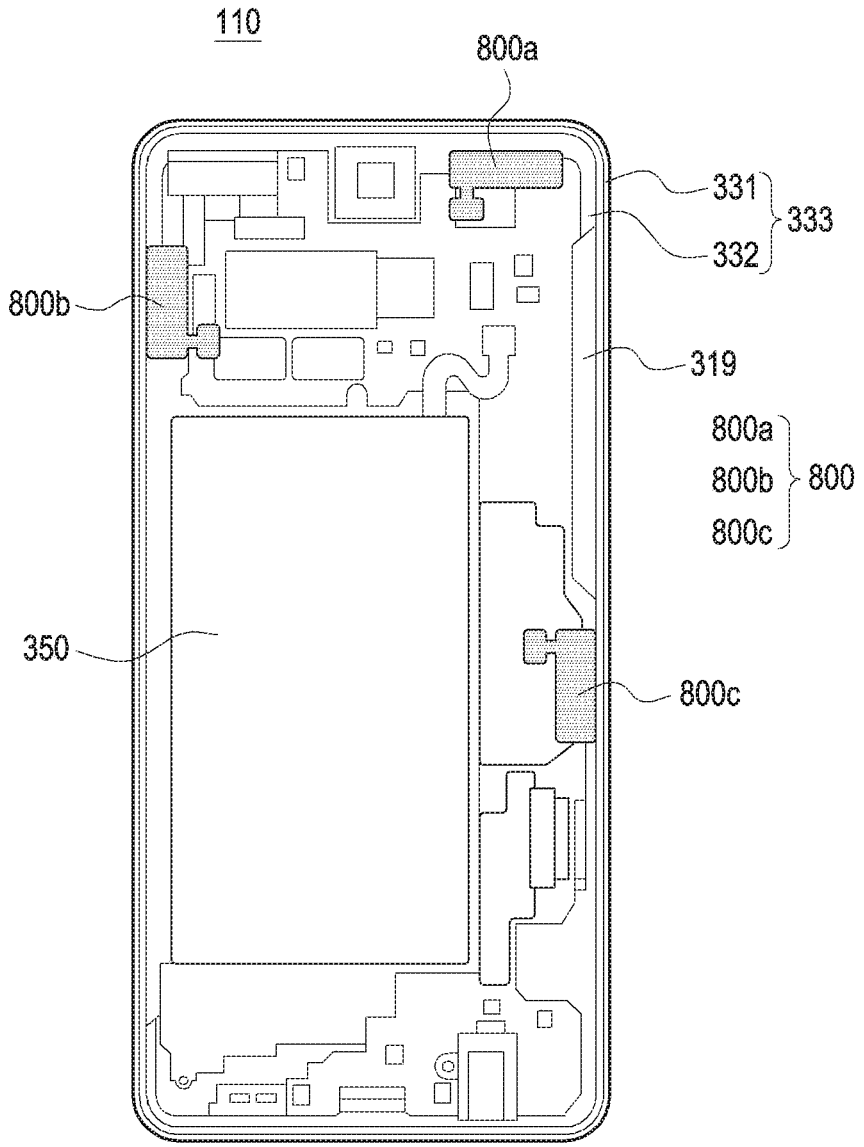
FIG. 19 is a view illustrating an arrangement of antenna modules within an electronic device according to various embodiments.

FIG. 19 is a view illustrating an arrangement of antenna modules within an electronic device according to various embodiments.

Referring to FIG. 15, the electronic device 101 may include a housing 310, antenna modules 800, and an antenna housing 910. The configuration of the housing 310 of FIG. 15 may be partially or wholly the same as the configuration of the housing of FIGS. 1 to 4, and the configurations of the antenna modules 800 and the antenna housing 910 of FIG. 15 may be partially or wholly the same as the configurations of the antenna modules 800 and the antenna housing 910 of FIGS. 6A to 7B.

According to various embodiments, the housing (e.g., the housing 310 in FIG. 2) may include a front plate (e.g., the front plate 302 in FIG. 2), a rear plate (e.g., the rear plate 311 in FIG. 3), and a side member 333, and the side member 333 may include a side bezel structure 331 and a bracket 332 extending inwards from the side bezel structure 331. At least a portion of the side bezel structure 331 may be formed of a metal material, and the bracket 332 may be formed of a nonmetal material.

According to various embodiments, the antenna module 800 mounted in the antenna housing may be disposed in at least one area of the bracket 332. The antenna module 800 may include a patch antenna facing the rear side and/or a dipole antenna facing the lateral side. Multiple antenna modules 800 may be disposed along the edges of the bracket 332. For example, three antenna modules 800 may be provided, and a first antenna module 800*a* may be disposed in an area adjacent to a camera or a receiver along an upper edge area of the bracket 332. A second antenna module 800*b* may be provided so as to have the same structure and shape as the first antenna module 800*a*, or may be provided so as to have a shape different from that of the first antenna module 800*a* and corresponding to the shape of the side member 333. The second antenna module 800*b* may be disposed along the left edge area of the bracket 332. The second antenna module 800*b* may be disposed in the upper or lower area of the battery 350. A third antenna module 800*c* may be provided so as to have the same structure and shape as the first antenna module 800*a*, or may be provided so as to have a shape different from that of the first antenna module 800*a* and corresponding to the shape of the side member 333. The third antenna module 800*c* may be disposed along the right edge area of the bracket 332. The third antenna module 800*c* may be disposed in the upper or lower area of the key button 317 mounted on the side face. However, the number and arrangement of antenna modules are not limited to what is illustrated in the drawing, and two or fewer or four or more antenna modules may be disposed along the edge areas of the bracket 332, and may be located at various positions in consideration of the relationship between the antenna modules and the internal components disposed in the bracket 332 and of the mounting space.

An electronic device (e.g., 101 in FIGS. 1 to 3) according to various embodiments may include a case (e.g., 310 in FIG. 11) forming at least part of an external appearance of the electronic device; a printed circuit board (e.g., 340 in FIG. 11) disposed in an inner space of the case; an antenna module (e.g., 800 in FIG. 11) positioned in the inner space, and including at least one first conductive element (e.g., 820 in FIG. 11) arranged to form a predetermined slope with respect to one face of the printed circuit board; an RF communication module (e.g., 840 in FIG. 11) electrically connected with the antenna module and configured to transmit and/or receive a signal having a frequency of 6 GHz to 300 GHz; and a heat dissipation member (e.g., 920 or 930 in FIG. 11) disposed adjacent to the antenna module and configured to dissipate heat generated from the antenna module.

According to various embodiments, the first conductive element (e.g., 820 in FIG. 11) may include a conductive plate.

According to various embodiments, the first conductive element may transmit or receive a high-frequency signal through a first radiation area (e.g., S1 in FIG. 11), and the first radiation area may include at least part of the case made of a nonmetal material.

According to various embodiments, the case may include a flat first portion and a second portion extending from the first portion and including at least one curved portion, and the printed circuit board may be disposed substantially parallel to the first portion.

According to various embodiments, the antenna module may further include an antenna housing (e.g., 910 in FIG. 11) configured to fix the antenna module within the inner space.

According to various embodiments, the antenna housing may include a fixing face (e.g., 911 in FIG. 10B) disposed within the inner space; a seating face (e.g., 912 in FIG. 10B) having a predetermined inclined face on which the antenna module is seated; a coupling member (e.g., 913 in FIG. 10B) configured to fix the antenna module seated on the seating face; and a fixing member connecting a portion of the fixing face and another component of the electronic device so as to fix the antenna housing within the inner space.

According to various embodiments, the antenna housing may be manufactured to include a metal material in order to dissipate heat generated from the antenna module, or may be provided through insert injection molding of the metal material.

According to various embodiments, the heat dissipation member is attached to at least part of the antenna module or the antenna housing.

According to various embodiments, the heat dissipation member may include a first heat dissipation member disposed between the antenna housing and the antenna module and a second heat dissipation member disposed on the outer face of the antenna housing.

According to various embodiments, the antenna module (e.g., 800 in FIG. 9B) may further include a flexible circuit board (e.g., 850 in FIG. 9B) electrically connecting the printed circuit board and the first conductive element, and the flexible circuit board may include a first portion (e.g., 850*a* in FIG. 9B) in which the first conductive element is disposed and a second portion (e.g., 850*b* in FIG. 9B) in which a connector is disposed.

According to various embodiments, the antenna module may include at least one second conductive element (e.g., 830 in FIG. 9B) disposed to be oriented in a direction different from a direction in which the at least one first conductive element is oriented.

According to various embodiments, the second conductive element may form a dipole antenna, and a direction in which the first conductive element is oriented and a direction in which the second conductive element is oriented may be substantially perpendicular to each other.

According to various embodiments, the first conductive element may transmit or receive the signal through a first radiation area, and the first radiation area may include a first area of the case that is made of a non-metal material. The second conductive element may transmit or receive the signal through a second radiation area, and the second radiation area may include a second area of the case that is made of a non-metal material.

According to various embodiments, the antenna module may include a first layer (e.g., 811 in FIG. 9B) having a first area, and a second layer (e.g., 812 in FIG. 9B) having a second area smaller than the first area and disposed on or above the first layer, and the central portion of the second layer may be disposed closer to the rear face than the central portion of the first layer.

According to various embodiments, the antenna module may include at least one second conductive element disposed to be oriented in a direction different from a direction in which the at least one first conductive element is oriented. The at least one first conductive element may be disposed on one face of the first layer or inside the first layer, and the at least one second conductive element may be disposed on one face of the second layer or inside the second layer.

According to various embodiments, the antenna module may further include a third layer (e.g., 813 in FIG. 9B) having a third area smaller than the first area and larger than the second area and stacked between the first layer and the second layer, and the central portion of the second layer may be disposed closer to the rear face than the central portion of the third layer.

An electronic device (e.g., 101 in FIG. 11) according to various embodiments may include a front cover (e.g., 302 in FIG. 11) forming at least part of a front face of the electronic device; a rear cover (e.g., 311 in FIG. 11) forming at least part of a rear face of the electronic device; a display (e.g., 330 in FIG. 11) disposed adjacent to the front cover to be seen through a first portion of the front cover; a printed circuit board (e.g., 340 in FIG. 11) disposed between the display and the rear cover; an antenna housing (e.g., 910 in FIG. 11) located between the display and the rear cover and including an inclined face forming a predetermined slope with respect to the printed circuit board; and an antenna module (e.g., 800 in FIG. 110) disposed on the inclined face of the antenna housing. The antenna module may include a board (e.g., 810 in FIG. 11), a first conductive element (e.g., 820 in FIG. 11) including an array of multiple conductive plates disposed on or inside the board, and an RF communication circuit (e.g., 840 in FIG. 11) electrically connected to the first conductive element and configured to transmit and/or receive a signal having a frequency of 6 GHz to 300 GHz.

According to various embodiments, the electronic device may further include a heat dissipation member disposed adjacent to the antenna module and configured to dissipate heat generated from the antenna module, and the heat dissipation member may be attached to at least part of the antenna housing or the antenna module.

According to various embodiments, the first conductive element may transmit or receive the signal through a radiation area, and the radiation area may include a portion of the rear cover made of a nonmetal material.

According to various embodiments, the antenna housing may be provided in an integrated form, and may further include a fixing face for supporting and a recessed seating face having a predetermined slope with respect to the fixing face. According to various embodiments, the board may include a first layer having a first area, a second layer having a second area smaller than the first area and disposed on the first layer, and a third layer having a third area smaller than the first area and larger than the second area and stacked between the first layer and the second layer, and the central portion of the second layer may be disposed closer to the rear cover than the central portion of the third layer.

A portable communication device (e.g., 101 in FIG. 11) according to various embodiments may include a display (e.g., 330 in FIG. 11) including a flat face; a housing (e.g., 310 in FIG. 11) accommodating the display, and including a first wall (e.g., 311 in FIG. 11) that is substantially parallel to the flat face of the display and a second wall (e.g., 333 in FIG. 11) that is substantially perpendicular to the first wall, wherein the second wall includes a conductive portion and a non-conductive portion located between the first wall and the conductive portion; an antenna support member (e.g., 910 in FIG. 11) that is spaced apart from the second wall of the housing and includes a face inclined with respect to the first wall of the housing; and an antenna structure (e.g., 800 in FIG. 11) disposed on the inclined face of the antenna support member. The antenna structure may include a printed circuit board (e.g., 810 in FIG. 11) disposed to be inclined with respect to the first wall of the housing; and an antenna array (e.g., 820 in FIG. 11) disposed on the printed circuit board to be inclined with respect to the first wall of the housing, and a first separation distance between an edge of the antenna array farthest from the first wall of the housing and the first wall of the housing may be smaller than a second separation distance between the conductive portion of the second wall of the housing and the first wall of the housing.

According to various embodiments, the antenna support member may include at least one protrusion protruding with respect to the inclined face.

According to various embodiments, the at least one protrusion may include a first protrusion protruding with respect to a first end of the inclined face and a second protrusion protruding with respect to a second end of the inclined face, and a separation distance between the first protrusion and the first wall may be different from a separation distance between the second protrusion and the first wall.

According to various embodiments, the at least one protrusion may further include a third protrusion protruding with respect to a side end formed between the first end and the second end of the inclined face.

According to various embodiments, the antenna structure may further include a radio frequency integrated circuit (RFIC) configured to transmit or receive a signal to and from outside the portable communication device through the antenna array.

According to various embodiments, the portable communication device may further include a heat dissipation member disposed between the antenna support member and the antenna structure.

An electronic device (e.g., 101 in FIG. 11) according to various embodiments may include a housing (e.g., 310 in FIG. 11) including a first plate (e.g., 302 in FIG. 11) exposed in a first direction (e.g., +Z in FIG. 11), a second plate (e.g., 311 in FIG. 11) exposed in a second direction (e.g., −Z in FIG. 11), which is opposite the first direction, and a side member (e.g., 333 in FIG. 11) formed at an edge of a space between the first plate and the second plate so as to connect the first plate and the second plate to each other; and an antenna module disposed within the space so as to be adjacent to the side member, and including a first face (e.g., 801 in FIG. 11) oriented in a third direction (e.g., T in FIG. 11) forming an acute angle with the second direction, wherein the antenna module may include a plurality of conductive plates (e.g., 821 in FIG. 9B) disposed on the first face in order to transmit an electromagnetic signal in the third direction.

According to various embodiments, the electronic device may further include an antenna support member (e.g., 910 in FIG. 11) arranged to be spaced apart from the second plate and configured to fix the antenna module to have a predetermined inclination within the space.

According to various embodiments, the antenna support member may be provided in an integrated form and may include a fixing face for supporting and a recessed seating face having a predetermined slope with respect to the fixing face.

According to various embodiments, the antenna module may include a board, the board may include a first layer having a first area and a second layer disposed on the first layer and having a second area smaller than the first area, wherein the second layer includes the first face on which the plurality of conductive plates are disposed.

According to various embodiments, the electronic device may further include a heat dissipation member disposed adjacent to the antenna support member and configured to dissipate heat generated from the antenna module, and the heat dissipation member may be attached to at least part of the antenna support member or the antenna module.

According to various embodiments, the antenna support member may include a first protrusion protruding with respect to a first end of the seating face having the predetermined inclination, and a second protrusion protruding with respect to a second end of the seating face having the predetermined inclination.

With an electronic device according to various embodiments, it is possible to provide an antenna module that ensures a separation distance from an element that prevents transmission and reception of an antenna signal inside an electronic device and that is improved in radiation performance.

With the electronic device according to various embodiments, it is possible to implement an antenna in a modular structure so as to solve a problem of limited mounting space and to simplify assembly and disassembly. In addition, it is possible to provide an antenna housing that is capable of providing an antenna radiation area in a designated direction in the state in which the antenna module is mounted, in order to ensure efficient antenna radiation.

With the electronic device according to various embodiments, it is possible to provide an arrangement and configuration of heat dissipation members for efficiently dissipating the heat generated by the antenna module.

With the electronic device according to various embodiments, it is possible to provide efficient antenna transmission and reception by controlling the arrangement of patch antennas or dipole antennas constituting the antenna module.

As will be apparent to a person ordinarily skilled in the technical field to which the disclosure belongs, the above-mentioned electronic devices according to various embodiments are not limited by the above-described embodiments and drawings, and may be variously substituted, modified, and changed within the technical scope of the disclosure.

What is claimed is:

1. An electronic device comprising:

a display;

a case forming at least part of an external appearance of the electronic device, the case including a display cover member forming at least part of a front exterior of the electronic device, a rear cover member forming at least part of a rear exterior of the electronic device, and a side wall member disposed between the display cover member and the rear cover member, the side wall member including a conductive portion and a non-conductive portion disposed adjacent to the conductive portion, a portion of the conductive portion exposed to an outside of the electronic device, and the rear cover member including a planar portion and a curved portion extended from the planar portion;

a printed circuit board disposed in the case;

an antenna support member accommodated in the case, and spaced apart from the rear cover member, the antenna support member including an inclined surface spaced apart from and substantially inclined with respect to the planar portion of the rear cover member;

a heat dissipation member disposed on the inclined surface of the antenna support member such that the heat dissipation member is spaced apart and substantially inclined with respect to the planar portion of the rear cover member; and a first antenna structure disposed over the inclined surface of the antenna support member via the heat dissipation member, the first antenna structure including a plurality of patch antennas and a radio frequency (RF) communication module disposed between the plurality of patch antennas and the heat dissipation member, the plurality of patch antennas substantially parallel with the inclined surface and substantially inclined with respect to the planar portion of the rear cover member, the plurality of patch antennas configured to transmit beam-forming signals through at least one portion of the curved portion of the rear cover member and at least one portion of the non-conductive portion of the side wall member.

2. The electronic device of claim 1, further comprising:

a second antenna structure including a plurality of patch antennas, wherein the first antenna structure is disposed adjacent to one of left or right side portion of the side wall member, and the second antenna structure is disposed adjacent to another one of the left or right side portion of the side wall member.

3. The electronic device of claim 2, further comprising:

a third antenna structure including a plurality of patch antennas and disposed adjacent to an upper side portion of the side wall member.

4. The electronic device of claim 1, wherein the antenna support member includes a first protrusion protruding with respect to a first end of the inclined surface and a second protrusion protruding with respect to a second end of the inclined surface.

5. The electronic device of claim 1, wherein the antenna support member further includes a mounting surface which is parallel with the planar portion of the rear cover member.

6. The electronic device of claim 5, wherein the antenna support member further includes at least one coupling portion configured to couple the first antenna structure seated on the inclined surface, and wherein the mounting surface of the antenna support member is fixed on a bracket accommodated in the case.

7. The electronic device of claim 6 wherein the antenna support member is manufactured to include a metal material in order to dissipate heat generated from the first antenna structure, or is provided through insert injection molding of the metal material.

8. The electronic device of claim 1, wherein the the plurality of patch antennas include conductive plates, each of the conductive plate is configured, together, to transmit or receive a high-frequency signal between 6 GHz and 300 GHz as at least part of the beam-forming signals.

9. The electronic device of claim 1, wherein the printed circuit board is disposed substantially parallel to the planar portion of the rear cover member.

10. The electronic device of claim 1, wherein the first antenna structure further includes a flexible circuit board connecting the printed circuit board, and wherein the flexible circuit board includes a first portion in which the plurality of patch antennas are disposed and a second portion in which a connector is disposed.

11. The electronic device of claim 1, wherein the first antenna structure further includes at least one conductive element disposed to be oriented in a direction different from a direction in which the plurality of patch antennas is oriented.

12. The electronic device of claim 11, wherein the plurality of patch antennas of the first antenna structure is configured to, together, transmit or receive the beam-forming signals through a first radiation area, and the first radiation area includes a first area of the case that is made of a non-metal material, and wherein at least one conductive element is configured to, together, transmit or receive another beam-forming signals through a second radiation area, and the second radiation area includes a second area of the case that is made of a non-metal material.

13. The electronic device of claim 1, wherein the first antenna structure includes a first layer having a first area, and a second layer having a second area smaller than the first area and disposed on or above the first layer, and wherein a central portion of the second layer is disposed closer to the rear cover member than a central portion of the first layer.

14. The electronic device of claim 13, wherein the first antenna structure includes at least one conductive element disposed to be oriented in a direction different from a direction in which the plurality of patch antennas are oriented, wherein the plurality of patch antennas are disposed on one face of the first layer or inside the first layer, and wherein the at least one conductive element is disposed on one face of the second layer or inside the second layer.

15. An electronic device comprising:

a display;

a case forming at least part of an external appearance of the electronic device, the case including a display cover member forming at least part of a front exterior of the electronic device, a rear cover member forming at least part of a rear exterior of the electronic device, and a side wall member disposed between the display cover member and the rear cover member, the side wall member including a conductive portion and a non-conductive portion disposed adjacent to the conductive portion, a portion of the conductive portion exposed to an outside of the electronic device, and the rear cover member including a planar portion and a curved portion extended from the planar portion;

an antenna support member accommodated in the case, and spaced apart from the rear cover member, the antenna support member including an inclined surface spaced apart from the rear cover member and substantially inclined with respect to the planar portion of the rear cover member;

a heat dissipation member disposed on the inclined surface of the antenna support member such that the heat dissipation member is substantially inclined with respect to the planar portion of the rear cover member; and an antenna structure disposed over the inclined surface of the antenna support member via the heat dissipation member, the antenna structure including a plurality of patch antennas and a radio frequency (RF) communication module disposed between the plurality of patch antennas and the heat dissipation member, the plurality of patch antennas substantially parallel with the inclined surface and substantially inclined with respect to the planar portion of the rear cover member, the plurality of patch antennas configured to transmit beam-forming signals through at least one portion of the curved portion of the rear cover member and at least one portion of the non-conductive portion of the side wall member.

16. The electronic device of claim 15, wherein the plurality of the patch antennas includes a first patch antenna and a second patch antenna configured, together, to transmit or receive a high-frequency signal between 6 GHz and 300 GHz as at least part of the beam-forming signals.

17. The electronic device of claim 15, further comprising:

a printed circuit board disposed as substantially parallel with the planar portion of the rear cover member.

18. The electronic device of claim 15, wherein the antenna support member is fixed on a bracket accommodated in the case.

19. The electronic device of claim 18, wherein the antenna support member includes another surface substantially parallel with the planar portion of the rear cover member, and wherein the other surface of the antenna support member is fixed on the bracket via a fastening member.

20. The electronic device of claim 18, wherein an ending portion of the bracket is extended toward the side wall member such that the ending portion forms the portion of the conductive portion of the side wall member exposed to the outside.

21. The electronic device of claim 15, wherein the heat dissipation member is attached to at least part of the antenna structure, and wherein a heat generated from the RF communication module is to be dissipated to a bracket at least via the heat dissipation member and the inclined surface of the antenna support member.

22. The electronic device of claim 15, further comprising a printed circuit board disposed as substantially parallel with the planar portion of the rear cover member, wherein the antenna structure includes a flexible circuit board connecting the printed circuit board, and wherein the flexible circuit board includes a first portion in which the plurality of patch antennas are disposed and a second portion in which a connector is disposed.

23. The electronic device of claim 15, wherein the antenna structure further includes another one or more antennas disposed to be radiated as substantially perpendicular to the inclined surface of the antenna support member.

24. The electronic device of claim 23, wherein the plurality of patch antennas is configured to, together, transmit or receive the beam-forming signals through a first radiation area, and the first radiation area includes a first area of the case that is made of a non-metal material, and wherein the other one or more antennas is configured to, together, transmit or receive another beam-forming signals through a second radiation area, and the second radiation area includes a second area of the case that is made of a non-metal material.

25. The electronic device of claim 15, wherein the antenna structure includes a first layer having a first area, and a second layer having a second area smaller than the first area and disposed on or above the first layer, and wherein a central portion of the second layer is disposed closer to the rear cover member than a central portion of the first layer.

26. The electronic device of claim 25, wherein the antenna structure includes at least one conductive element disposed to be oriented in a direction different from a direction in which the plurality of patch antennas are oriented, wherein the plurality of patch antennas are disposed on one face of the first layer or inside the first layer, and wherein the at least one conductive element is disposed on one face of the second layer or inside the second layer.

27. The electronic device of claim 15, wherein the antenna support member includes at least one protrusion protruding as substantially perpendicular with respect to the inclined face.

28. The electronic device of claim 27, wherein the at least one protrusion includes a first protrusion protruding with respect to a first ending portion of the inclined surface and a second protrusion protruding with respect to a second ending portion of the inclined surface face opposite to the first ending portion, and wherein a first distance between the first protrusion and the rear cover member is different from a second distance between the second protrusion and the rear cover member.

* * * * *